US006298835B1

(12) United States Patent
Horie et al.

(10) Patent No.: US 6,298,835 B1
(45) Date of Patent: Oct. 9, 2001

(54) EGR CONTROL SYSTEM FOR INTERNAL COMBUSTION ENGINE

(75) Inventors: Kaoru Horie; Hitoshi Takahashi; Michio Shinohara; Masao Kubodera; Hiromi Matsuura, all of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/580,455

(22) Filed: May 30, 2000

(30) Foreign Application Priority Data

May 31, 1999 (JP) ..... 11-152465

(51) Int. Cl.[7] ..... F02M 25/07; F02B 17/00; F02D 11/10

(52) U.S. Cl. ..... 123/568.21; 123/295; 123/399; 123/568.2

(58) Field of Search ..... 123/295, 305, 123/568.11, 568.2, 568.21, 399; 701/108

(56) References Cited

U.S. PATENT DOCUMENTS 4,366,799 * 1/1983 Suda ..... 123/568.2
4,924,840 * 5/1990 Wade ..... 123/568.2
5,950,595 * 9/1999 Yoshioka et al. ..... 123/295
5,979,396 * 11/1999 Yasuoka ..... 123/295
6,058,906 * 5/2000 Yoshino ..... 123/568.21
6,079,387 * 6/2000 Mamiya et al. ..... 123/295
6,089,212 * 7/2000 Piock et al. ..... 123/568.2
6,101,999 * 8/2000 Ohashi et al. ..... 123/568.21
6,142,117 * 11/2000 Hori et al. ..... 123/568.21
6,167,863 * 2/2001 Kazama et al. ..... 123/568.21
6,199,537 * 3/2001 Kowatari et al. ..... 123/568.21

FOREIGN PATENT DOCUMENTS 9-32651 2/1997 (JP) .

* cited by examiner

*Primary Examiner*—Willis R. Wolfe
(74) *Attorney, Agent, or Firm*—Arent Fox Kintner Plotkin & Kahn, PLLC

(57) ABSTRACT

An EGR control system for a direct injection spark ignition engine operated at a plurality of the combustion modes comprising stratified-charge combustion and premix-charge combustion. The system includes a flow rate control valve equipped at the EGR passage to regulate flow rate of the exhaust gas to be recirculated which is operated when the one combustion mode is determined to be changed to another of a plurality of the combustion modes, thereby ensuring an EGR amount that is neither deficient nor excessive for the combustion mode, while preventing misfire from happening and preventing the degradation of drivability, fuel economy and emission performance from occurring. Alternatively, the system includes an actuator for regulating an opening of a throttle valve or a second EGR control valve installed in a branch passage and a passage switching valve for switching the EGR passage and the branch passage.

18 Claims, 23 Drawing Sheets

EGR CONTROL SYSTEM FOR INTERNAL COMBUSTION ENGINE

BACKGROUND OF THE INVENTION

1. Field of the Invention

This invention relates to an EGR control system for an internal combustion engine.

2. Description of the Related Art

In internal combustion engines, EGR (Exhaust-Gas Recirculation) control for recirculating part of the exhaust gas is conducted in order to improve fuel economy and reduce exhaust gas pollutants.

Recent years have seen the development of direct-injection spark ignition internal combustion engines where gasoline fuel is injected directly into the combustion chamber to achieve lean stratified-charge combustion. EGR control has also been applied to this type of engine. An example can be found in Japanese Laid-open Patent Application No. Hei 9 (1997)-32651.

When a direct-injection spark ignition engine is operating in the low engine speed and low engine load region, gasoline fuel is injected during the compression stroke to cause stratified-charge combustion (ultra-lean burn combustion) at an air-fuel ratio of, for instance, 30:1 or greater. When the engine is operating in the high engine speed and high engine load region, gasoline fuel is injected during the intake stroke to cause premix-charge combustion (uniform combustion) at an air-fuel ratio of, for instance, 20:1 or less.

In the stratified-charge combustion region, the EGR amount (or rate) should preferably be increased to reduce the NOx (nitrogen oxides) content. As can be seen from FIG. 27, if the EGR amount is increased, stratified-charge combustion does not fluctuate greatly and remains stable, since the marginal limit of EGR is high owing to the stratification. In the premix-charge combustion region, however, combustion grows increasingly unstable with increasing EGR amount. Thus, the marginal limit of EGR is lower than in the stratified combustion region and the required EGR amount is relatively small.

Viewing this from a different point, as shown in FIG. 28, a large amount of EGR gas is required for NOx reduction in the stratified-charge combustion region. However, introduction of EGR gas is difficult, since the pressure difference between the intake air and the exhaust gas becomes small when the engine operates with full-throttle.

In the premix-charge combustion region, on the other hand, the pressure difference between the intake air and the exhaust gas is sufficient, since the engine load is regulated through the throttle opening, similarly to the case of an ordinary engine where gasoline fuel is injected before the intake valve(s). As shown in FIG. 27, however, increasing the EGR amount destabilizes combustion and the margin of EGR is therefore not high. This means that the diameter or capacity of an EGR control valve need be only about the same as that in an ordinary engine where fuel is injected before the intake valve(s).

It can thus be seen that the marginal limit of EGR differs between the stratified-charge combustion region and the premix-charge combustion region in the direct-injection spark ignition engine. However, the combustion mode must frequently be switched between the stratified-charge combustion and the premix-charge combustion in response to the engine operating conditions.

Therefore, if the characteristic of the EGR control valve is designed or set with the focus on the premix-charge combustion region where the marginal limit of EGR is relatively low, then, as shown in FIGS. 29A and 29B, the EGR control valve response is deficient when the combustion mode is switched to the stratified-charge combustion in response to a change in the engine operating condition. The EGR amount is therefore insufficient. On the other hand, if the characteristic of the EGR valve is designed or set with focus on the stratified-charge combustion region, the EGR control valve response becomes too high when the combustion mode is switched to the premix-charge combustion. The EGR amount therefore becomes excessive.

As shown in FIG. 29C, the deficient/excessive EGR amount destabilizes combustion to cause misfiring and degraded drivability, and further, as shown in FIG. 29D, increases unburnt HCs (hydrocarbons) that degrade emission performance. While designing the EGR amount low prevents misfiring etc., this expedient is undesirable, since it makes full utilization of the expected engine performance impossible and is also disadvantageous in terms of fuel economy.

The technique proposed in the aforesaid prior art of coping with these problems is to drive the EGR control valve at a high speed when the combustion mode is switched from the stratified-charge combustion to the premix-charge combustion and to drive it at a lower speed when the combustion mode is switched from the premix-charge combustion to the stratified-charge combustion.

However, the aim of this prior art technique is to achieve exhaust gas purification by conducting EGR control in the stratified-charge combustion region and the premix-charge combustion region, and to prevent engine output deficiency and to lower torque shock when the combustion mode is switched, while preventing transient deterioration of combustion when the EGR amount (or ratio) is changed. Specifically, in this prior art, the purpose in increasing the EGR valve driving speed when the combustion mode is switched to premix-charge combustion is to improve response to demand for increased engine output without causing combustion deterioration. And the purpose in decreasing the EGR driving speed when the combustion mode is switched to the stratified-charge combustion is to avoid combustion deterioration at the time of transition.

It has also been proposed in this prior art to make the driving speed of the EGR control valve higher in the closing direction than in the opening direction. However, the principle involved in this prior art is the same as that just explained.

In other words, the prior art is limited to changing the driving speed of the EGR valve in response to the combustion mode and does not propose an improved EGR mechanism for an engine with different combustion modes that is responsive to the combustion mode for realizing an EGR amount that is neither deficient nor excessive.

SUMMARY OF THE INVENTION

An object of this invention is therefore to overcome the foregoing shortcomings by providing an EGR control system for an internal combustion engine having different combustion modes with an improved EGR mechanism which can ensure an EGR amount that is neither deficient nor excessive required for the combustion mode, while preventing misfire from happening and preventing the degradation of drivability, fuel economy and emission performance from occurring.

For realizing this object, the present invention provides a system for controlling an EGR mechanism, installed in an internal combustion engine, having an EGR passage connecting an air intake system and an exhaust system of the engine to recirculate a portion of exhaust gas produced by the engine to the air intake system and an EGR control valve equipped at the EGR passage to regulate an amount of the exhaust gas to be recirculated; comprising; engine operating condition detecting means for detecting operating conditions of the engine; combustion mode determining means for determining one of a plurality of combustion modes of the engine based on the detected operating conditions of the engine; and EGR mechanism operating means for operating an EGR control valve of the EGR mechanism based on the detected operating conditions of the engine. The system includes at least one of a flow rate control valve equipped at the EGR passage to regulate flow rate of the exhaust gas to be recirculated and an actuator for regulating an opening of a throttle valve provided at the air intake system; and the EGR mechanism operating means operates the EGR control valve and at least one of the flow rate control valve and the actuator, when the one combustion mode is determined to be changed to other of a plurality of the combustion modes.

BRIEF DESCRIPTION OF THE DRAWINGS

The above and other objects and advantages of the invention will be more apparent from the following description and drawings, in which.

DETAILED DESCRIPTION OF THE PREFERRED EMBODIMENTS

An EGR control system for an internal combustion engine according to an embodiment of the invention will now be explained with reference to the drawings.

Figure 1:
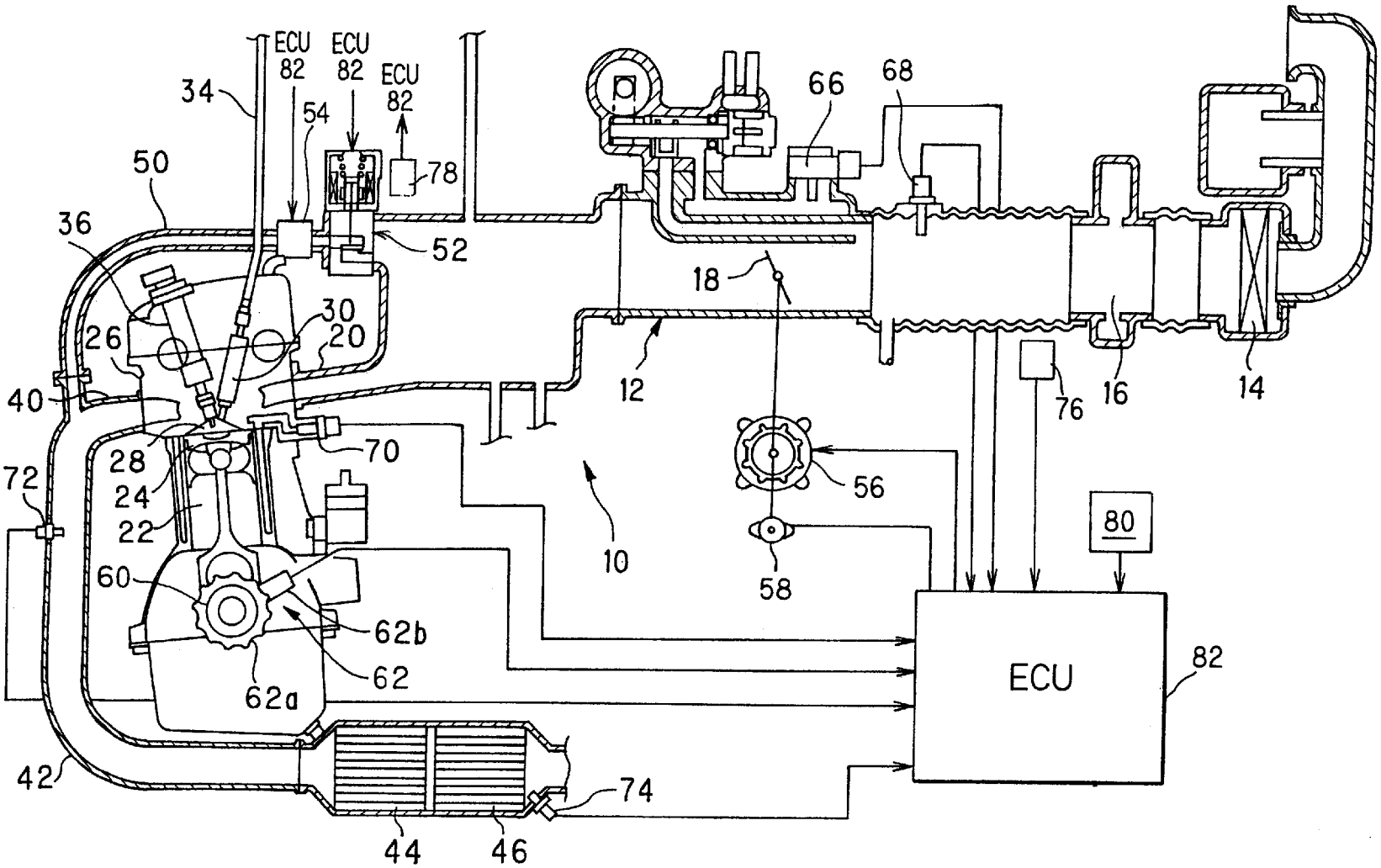
FIG. 1 is an overall schematic view of an EGR control system for an internal combustion engine according to an embodiment of the invention.

FIG. 1 is an overall schematic view of an EGR control system for an internal combustion engine according to the embodiment.

Reference numeral 10 in the drawing designates an in-line four-cylinder internal combustion engine (hereinafter called simply "engine"). Air drawn into an air intake pipe 12 through an air cleaner 14 mounted on its far end is supplied to first to fourth cylinders 22 through a surge tank 16, an intake manifold 20 and two air intake valves (not shown), while the flow thereof is adjusted by a throttle valve 18. Only one of the four cylinders is illustrated.

Each cylinder is equipped with a piston 24 movable therein. The head of the piston 24 has a concave portion and a combustion chamber 28 is formed between the piston head and the inner wall of a cylinder head 26. A fuel injector (made of a needle valve) 30 is installed to face into the middle region of the combustion chamber 28. The engine 10 of this embodiment is thus a direct-injection spark ignition engine where gasoline fuel is injected directly into the combustion chambers.

Each injector 30 is connected to a fuel supply pipe 34. Fuel (gasoline) from a fuel tank (not shown) is pressurized by a fuel pump (not shown) and is supplied to the injector 30 through the fuel supply pipe 34. When the injector 30 is made open, fuel is injected directly into the combustion chamber 28.

Spark plugs 36 are disposed at the combustion chambers 28 of the cylinders. The spark plugs 36 are supplied with electric energy for spark discharge from a device including ignition coils (not shown) so as to ignite an air-fuel mixture formed from the injected fuel and the intake air, at a prescribed ignition timing in the order of the first, third, fourth and second cylinders. The ignited air-fuel mixture explodes to drive down the associated piston 24.

The exhaust gas produced by the combustion is discharged through two exhaust valves (not shown) into an exhaust manifold 40 and then through an exhaust pipe 42 to a catalytic converter 44 for removing NOx components and a three-way catalytic converter 46, whereafter the purified exhaust gas is discharged into the exterior of the engine 10.

Downstream of the exhaust manifold 40, the exhaust pipe 42 is connected to the air intake pipe 12 (more exactly, the intake manifold 20) through an EGR passage 50 so as to recirculate a portion of the exhaust gas into the air intake system. More specifically, one end of the EGR passage 50 is connected to the exhaust pipe 42 downstream of the exhaust manifold 40 and upstream of the catalytic converters 44 and 46, and the other end thereof is connected to the air intake pipe 12 downstream of the throttle valve 18. The EGR passage 50 is equipped with an EGR control valve 52 for opening/closing the EGR passage 50 to regulate an amount of the exhaust gas to be recirculated, i.e. the EGR amount (flow rate) and these members constitute the EGR mechanism mentioned earlier.

The EGR control valve 52 comprises an electromagnetic solenoid valve whose solenoid (not shown) is driven at a duty ratio (in PWM-controlled) to vary the lift amount of the EGR valve 52, i.e. the valve opening (valve opening area) stepwise or continuously.

Figure 2:
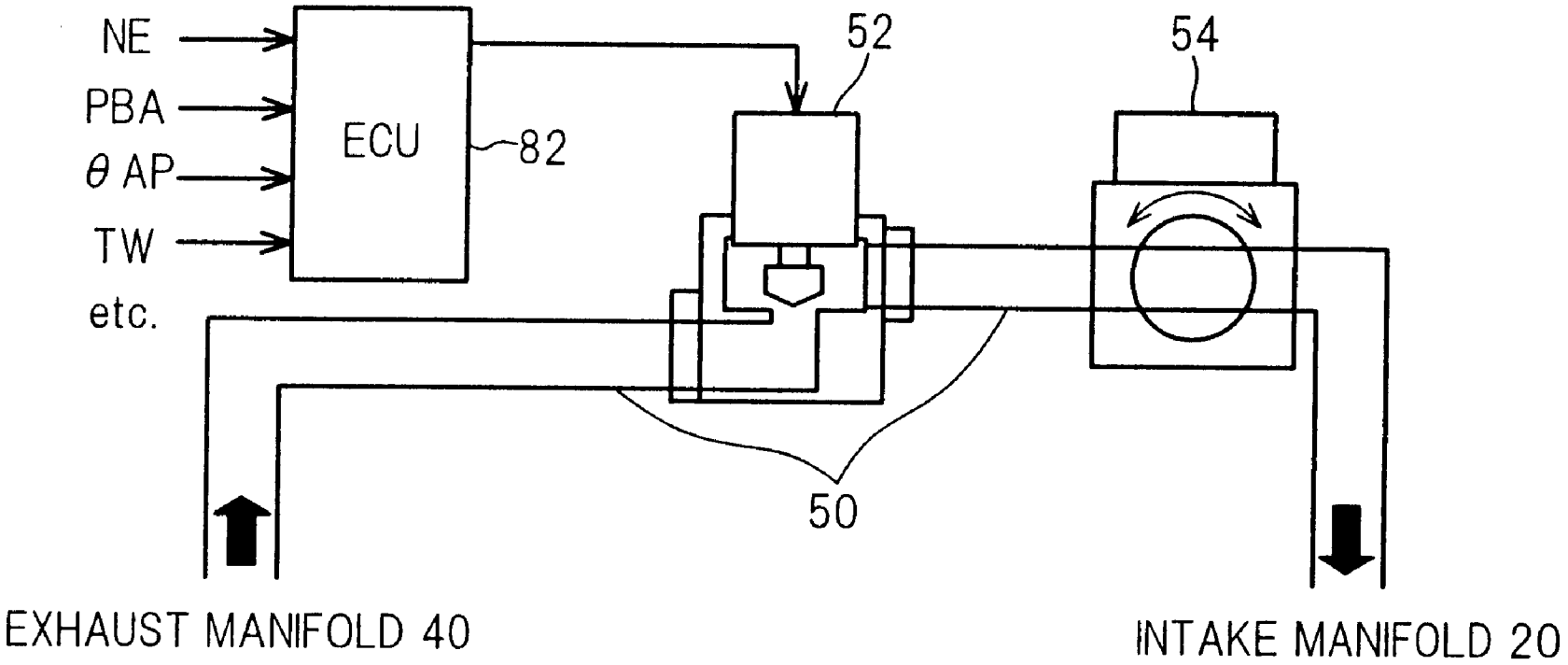
FIG. 2 is a schematic view functionally illustrating the system of FIG. 1 with particular focus on an EGR mechanism therein.

FIG. 2 is a schematic view functionally illustrating the system of FIG. 1 with particular focus on the EGR mechanism. As illustrated, a flow rate control valve 54 is provided in the EGR passage 50 downstream (in the EGR gas stream) of the EGR control valve 52 to regulate the flow rate of the exhaust gas to be recirculated. The flow rate control valve 54 is also an electromagnetic solenoid valve whose solenoid is also driven at a duty ratio to vary the valve lift amount continuously. The response of the flow rate control valve 54 is higher than that of the EGR control valve 52. Specifically, the characteristic of the flow rate control valve 54 is designed to have a large valve opening change per unit time.

Returning to the explanation of FIG. 1, the throttle valve 18 is connected to and driven by a stepper motor (actuator) 56. A throttle position sensor 58 is connected to the stepper motor 56 and generates a signal, in response to the rotation of the stepper motor and outputs a signal representing the throttle opening θTH.

The pistons 24 are connected to a crankshaft 60 and a crank angle sensor 62 is installed near the crankshaft 60. The crank angle sensor 62 is composed of a pulser 62*a* attached to the crankshaft 60 and a magnetic pickup 62*b* disposed to face the pulser 62*a* . The crank angle sensor 62 outputs a CYL signal for cylinder discrimination at a prescribed crank angle of a specified cylinder, i.e., once every crank angle of 720 degrees, outputs TDC signals at the top dead centers (TDCs; crank angles of 180 degrees) of the respective cylinders, and outputs a CRK signal once every 30-degree subdivision between TDC signals.

A manifold absolute pressure sensor (MAP) 66 is installed in the air intake pipe 12 downstream of the throttle valve 18. The manifold absolute pressure sensor 66 is supplied with the intake air pressure downstream of the throttle valve 18 through a passage not shown in the drawing and outputs a signal representing the manifold absolute pressure PBA. An intake air temperature sensor 68 is installed in the air intake pipe 12 upstream of the throttle valve 18 and outputs a signal representing the temperature TA of the intake air.

A coolant temperature sensor 70 is installed near the cylinder 22 and outputs a signal representing the engine coolant temperature TW. An $O_2$ sensor (air-fuel ratio sensor) 72 is installed in the exhaust pipe 42 upstream of the catalytic converters 44 and 46 and outputs a signal proportional to the oxygen concentration of the exhaust gas. An exhaust gas temperature sensor 74 is installed in the exhaust pipe 42 downstream of the catalytic converters 44 and 46 and outputs a signal proportional to the exhaust gas temperature TEX.

An atmospheric pressure sensor 76 is installed at an appropriate location in the engine 10 and outputs a signal proportional to the atmospheric pressure PA at the place where the engine 10 is located. A lift sensor 78 is installed near the EGR control valve 52 and outputs a signal proportional to the lift amount (displacement amount) LACT of the EGR control valve 52 and thus proportional to the actual EGR amount.

An accelerator pedal position sensor 80 is installed near the accelerator pedal (not shown) and outputs a signal representing the position or opening degree of accelerator pedal θAP operated by the vehicle operator.

The outputs of these sensors are sent to an Electronic Control Unit (ECU) 82. The ECU 82 comprises a microcomputer having a CPU, a ROM, a RAM and other components. Based on the values output from the sensors, the ECU 82 conducts fuel injection control, EGR control and the like as described in the following. The ECU 82 is equipped with a counter (not shown) for detecting the engine speed NE by counting the CRK signals output by the crank angle sensor 62.

The operation of the EGR control system for an internal combustion engine according to this embodiment will now be explained.

Figure 3:
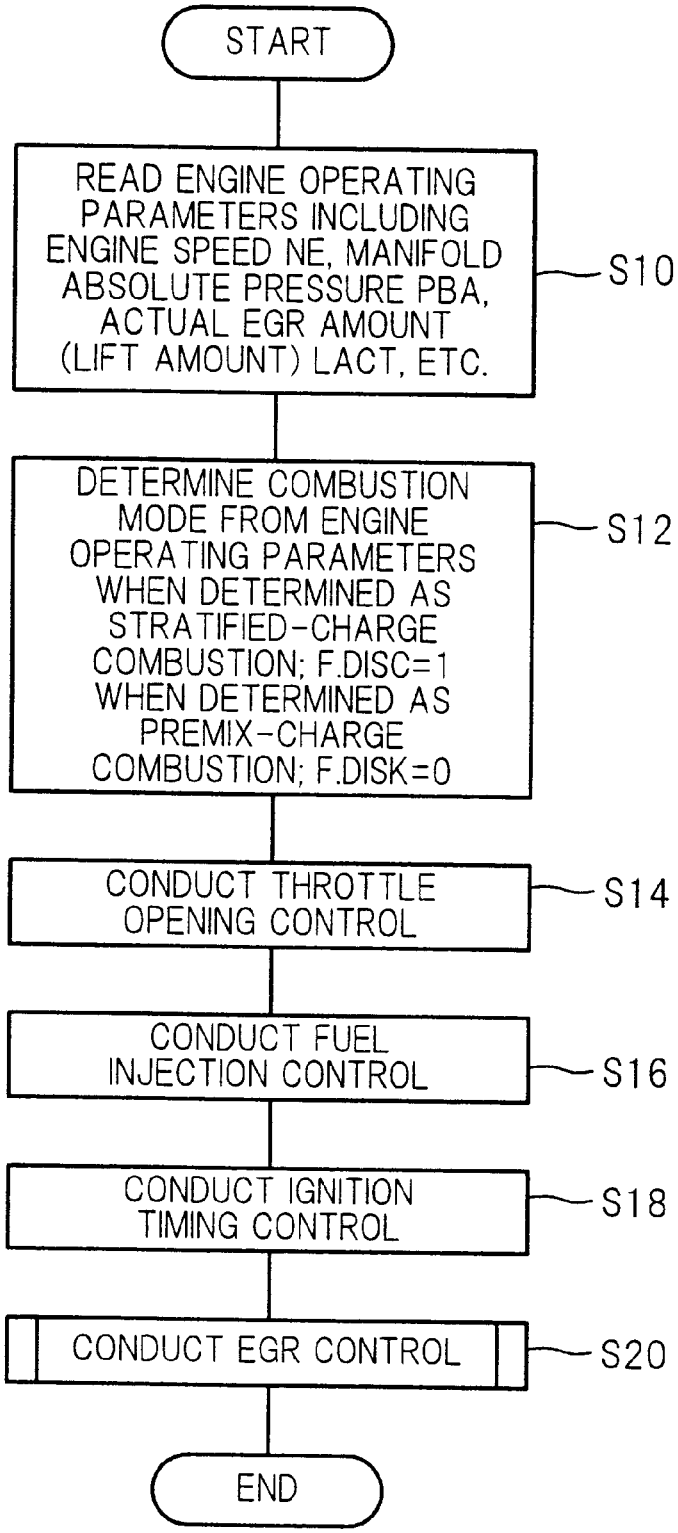
FIG. 3 is a flow chart showing the operation of the system illustrated in FIG. 1.

The overall control of the engine, including the EGR control, will first be outlined with reference to FIG. 3.

First, in S10, the operating parameters of the engine 10 are detected. These include, for instance, the engine speed NE, the manifold absolute pressure PBA (engine load), the actual EGR amount (in terms of valve lift amount) LACT and the like. These steps amount to reading the sensor outputs indicative of these operating parameters.

Next, in S12, the combustion mode is determined from the detected operating parameters. Since the engine 10 is a direct injection spark ignition engine, this amounts to determining from the detected operating parameters whether the combustion mode should be stratified-charge combustion or premix-charge combustion.

Figure 4:
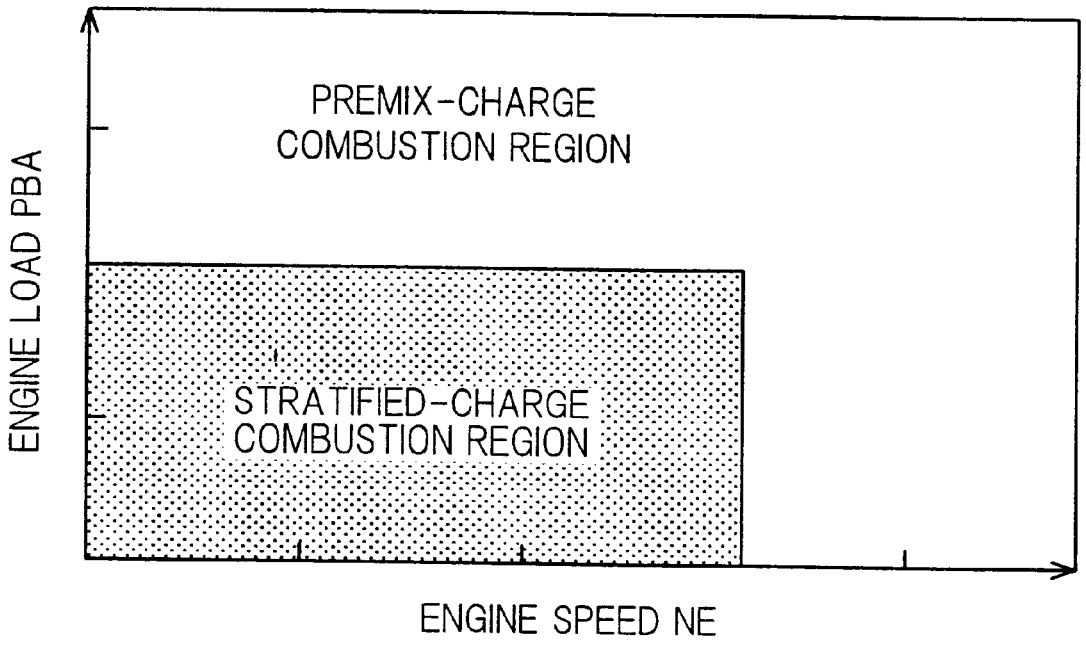
FIG. 4 is a graph showing characteristics of a map referred to in the flow chart of FIG. 3.

More specifically, the combustion mode is determined by retrieval from the map (whose characteristics are shown in FIG. 4) using the detected engine speed NE and manifold absolute pressure PBA (engine load) as address data. When it is determined that the combustion mode should be the stratified-charge combustion, the bit of a flag F.DISC is set to 1. When it is determined to be the premix-charge combustion, the bit is reset to 0. Thus this step determines one of a plurality of the combustion modes based on the detected operating conditions (the engine speed NE and the absolute manifold pressure PBA indicative of the engine load) of the engine 10.

Next, in S14, the control of the throttle opening is conducted.

The control of the illustrated direct injection spark ignition engine 10 will here be explained.

First, a desired torque PME is determined or calculated from the detected engine speed NE and accelerator pedal position θAP. A desired air-fuel ratio KCMD is then determined or calculated from the calculated desired torque PME and the detected engine speed NE. More specifically, the desired air-fuel ratio KCMD is determined such that the air-fuel ratio directly adjacent to the spark plug 36 falls between 12.0:1 and 15.0:1 independently of the engine load, while the rest of the combustion process proceeds such that air-fuel ratio falls between 12.0:1 and 22.0:1 during high engine load and high engine speed operation and at a higher level than this, up to 60.0:1, during low engine load and low-to-medium engine speed operation.

During premix-charge combustion, the fuel injection timing is set within the intake stroke so as to inject (supply) gasoline fuel at a prescribed crank angular position within the stroke. During stratified-charge combustion, the fuel injection timing is set within the compression stroke so as to inject gasoline fuel at a prescribed crank angular position within the stroke.

Parallel to this, a basic fuel injection amount TI is determined or calculated from the detected engine speed NE and the manifold absolute pressure PBA. An output fuel injection amount TOUT is then determined or calculated as shown below. (All fuel injection amounts are calculated as valve opening periods of time of the injector 30.)

$$TOUT=TI\times KCMDM\times KEGR\times KO_2\times KT+TT$$

In the above equation, KCMDM is a desired air-fuel ratio correction coefficient which is calculated by subjecting the desired air-fuel ratio KCMD to charging efficiency correction. (Both the desired air-fuel ratio correction coefficient KCMDM and the desired air-fuel ratio KCMD are actually calculated as equivalent ratios.) KEGR is a coefficient of correction by EGR and is calculated based on the desired EGR amount explained later. $KO_2$ is an air-fuel ratio feedback correction coefficient based on the output of the $O_2$ sensor 72. KT is the product of remainder correction terms of multiplication and TT is the sum of remainder correction terms of addition.

In S14, a desired value of the throttle opening θTH is determined or calculated based on the engine speed NE, the manifold absolute pressure PBA (engine load) and the combustion mode. And the manipulated variable to be supplied to the stepper motor 56 is determined or calculated based on the calculated desired throttle opening, and the result is then output through a driver (not shown). (In the stratified-charge combustion region, the throttle valve 18 is controlled to the fully opened position or to an opening or position large enough to obtain the manifold pressure near atmospheric pressure.

Next, in S16, the fuel injection amount (output fuel injection amount TOUT) is determined or calculated in the manner described above and is output at the prescribed crank angular position during the intake stroke or the compression stroke, depending on the determined combustion mode, thereby controlling the fuel injection amount and timing thereof.

Next in S18, the control of the ignition timing is conducted. A basic ignition timing is determined or calculated from the engine speed NE and the manifold absolute pressure PBA (engine load), an output ignition timing is calculated or determined by correcting the basic ignition timing for the engine coolant temperature and the like, and the output ignition timing is output at the determined crank angular position after an elapse of a prescribed time interval following fuel injection.

Next in S20, the EGR control is then conducted. Specifically, the EGR control valve 52 of the EGR mechanism is based on the detected operating conditions of the engine, more specifically, the EGR control valve 52 and the flow rate control valve 54 are operated, when the one combustion mode is determined to be changed to another of a plurality of the combustion modes.

Figure 5:
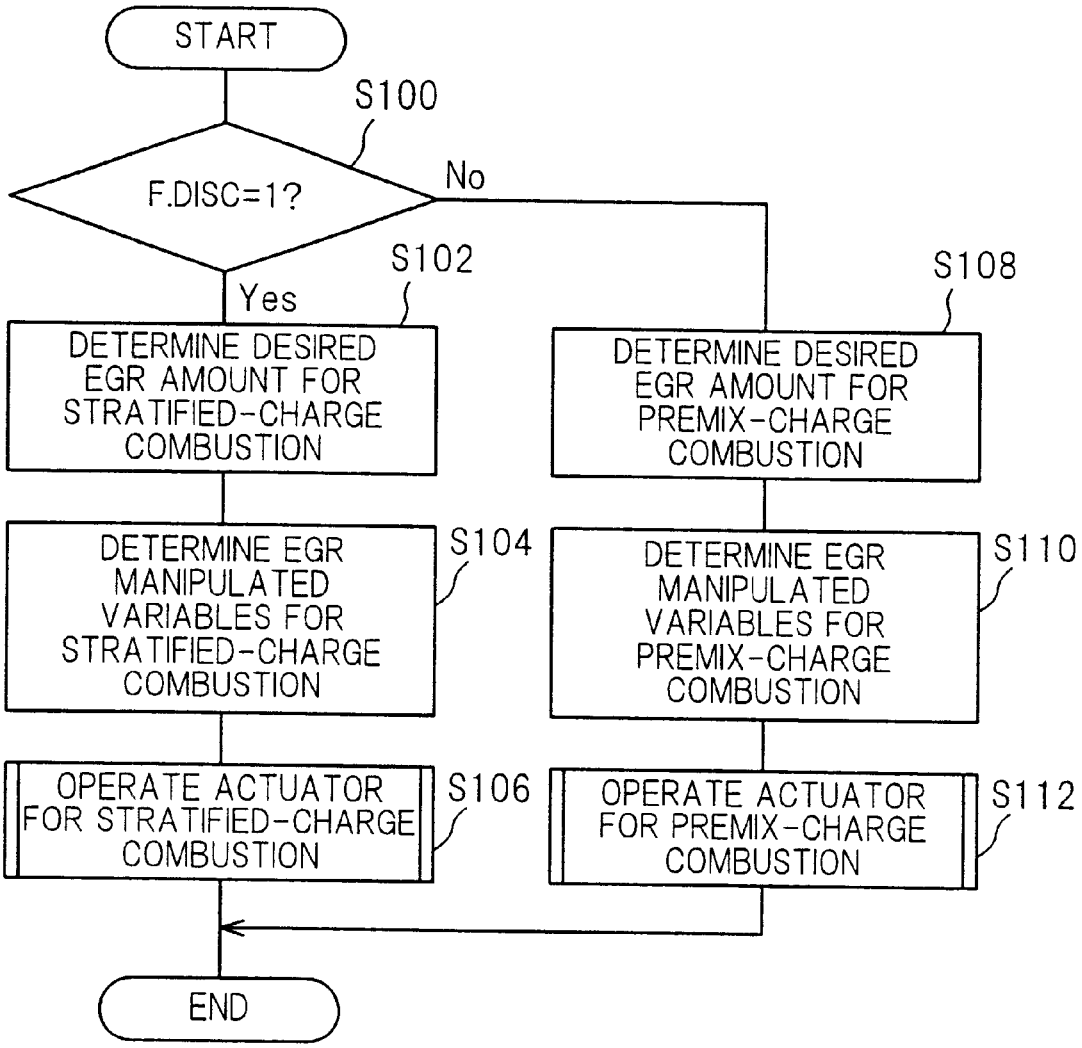
FIG. 5 is a flow chart showing the subroutine of the EGR control referred to in the flow chart of FIG. 3.

FIG. 5 is a subroutine flow chart of this EGR control.

In S100, it is determined whether the bit of the flag F.DISK is set to 1. When the result is YES, the program proceeds to S102, in which the detected engine speed NE, the detected manifold absolute pressure PBA, and the determined combustion mode are used to determine or calculate a desired EGR amount (or rate) in terms of EGR control valve 52 lift amount for the stratified-charge combustion.

Next, in S104, the EGR manipulated variables (control parameters) for stratified-charge combustion are determined. Specifically, the amounts of current to be supplied to the solenoids of the EGR control valve 52 and the flow rate control valve 54 are determined or calculated. Then, in S106, the EGR control actuator for stratified-charge combustion, i.e., the EGR control valve 52 and the flow rate control valve 54 is operated.

Figure 6:
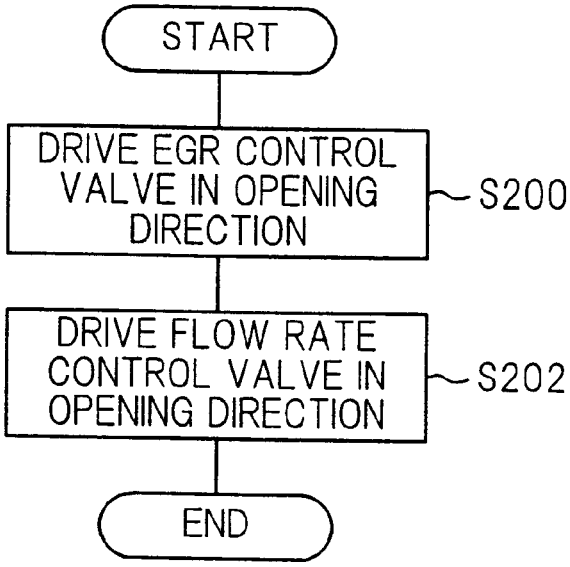
FIG. 6 is a flow chart showing the subroutine of the EGR control actuator for stratified-charge combustion referred to in the flow chart of FIG. 5.

The subroutine for these operations is shown in FIG. 6.

First, in S200, the EGR control valve 52 is driven in the opening direction. Then, in S202, the flow rate control valve 54 is also driven in the opening direction.

When the result in S100 of the flow chart of FIG. 5 is NO, the program proceeds to S108, in which the detected engine speed NE, the detected manifold absolute pressure PBA and the determined combustion mode are used to determine or calculate the desired EGR amount in terms of EGR control valve 52 lift amount for the premix-charge combustion.

Then, in S110, the EGR manipulated variables (control parameters) for premixcharge combustion are determined. Specifically, similarly to the case of stratified-charge combustion, the amounts of current to be supplied to the solenoids of the EGR control valve 52 and the flow rate control valve 54 are determined or calculated, whereafter, in S112, the EGR control actuator for premix-charge combustion (the EGR control valve 52 and the flow rate control valve 54) is operated.

Figure 7:
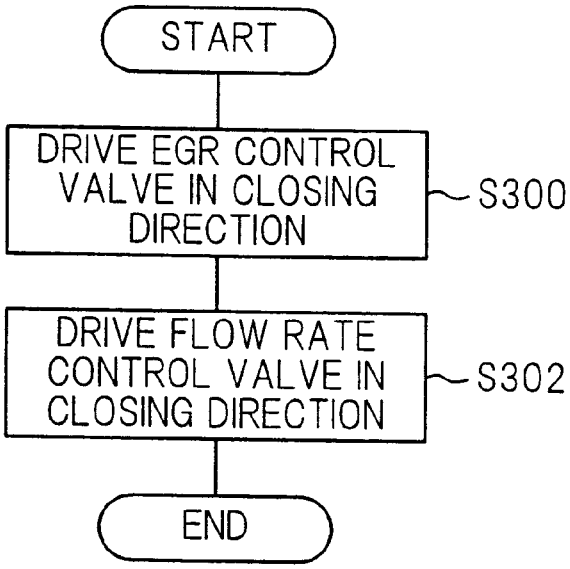
FIG. 7 is a flow chart showing the subroutine of the EGR control actuator for premix-charge combustion referred to in the flow chart of FIG. 5.

The subroutine for carrying out these operations is shown in FIG. 7.

First, in S300, the EGR control valve 52 is driven in the closing direction. Then, in S302, the flow rate control valve 54 is also driven in the closing direction.

The foregoing will now be explained with reference to FIG. 8.

Figure 8A:
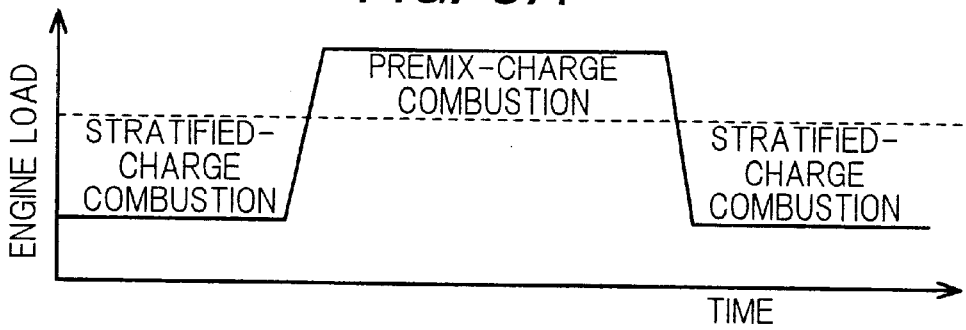
FIGS. 8A,8B,8C, and 8D is a set of time charts showing the operation of the flow chart of FIG.
Figure 8B:
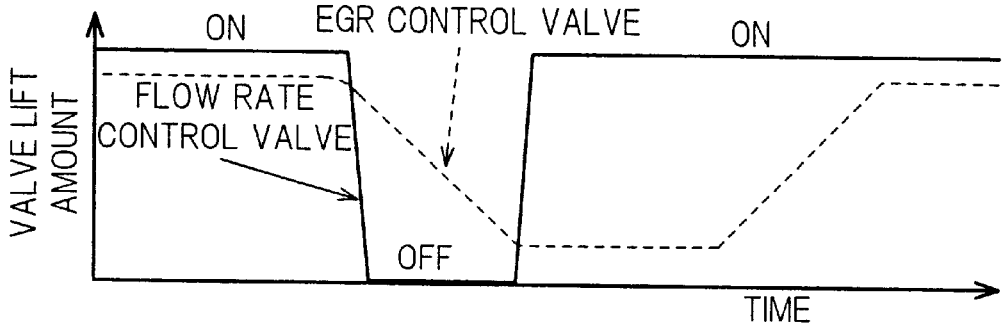
Figure 8C:
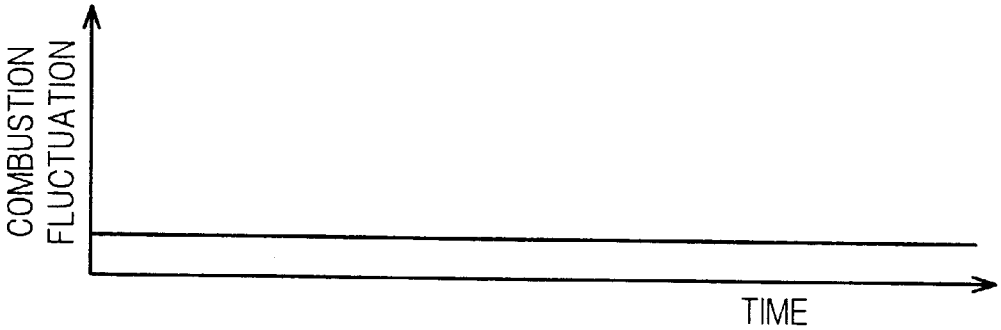
Figure 8D:
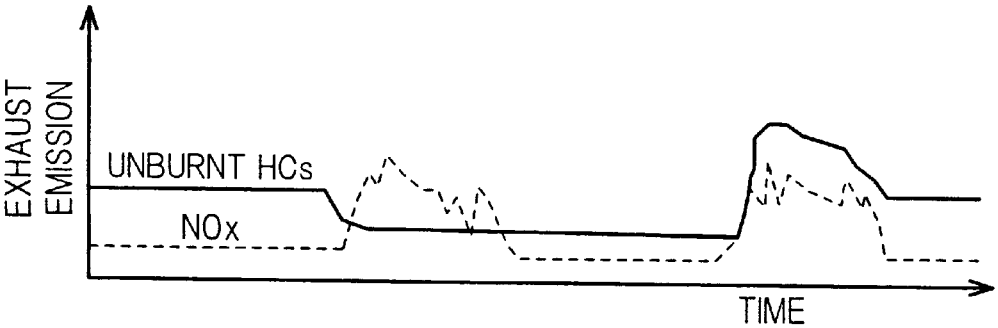

In the stratified-charge combustion region illustrated in FIG. 8A, since the margin of EGR is high, the embodiment is configured such that both the EGR control valve 52 and the flow rate control valve 54 are driven in the opening direction as illustrated in FIG. 8B. This enables to suppress the combustion fluctuation as illustrated in FIG. 8C, and enables the EGR amount to be increased and, as shown in FIG. 8D, the NOx and the unburnt HCs in the exhaust gas can be reduced, thus improving emission performance.

Now assume that an increase in engine load causes the combustion mode to switch from the stratified-charge combustion to the premix-charge combustion in which the marginal limit of EGR is relatively low. In this case, the result in S100 of the flow chart of FIG. 5 is NO, and the program proceeds to S108 and on to drive the EGR control valve 52 and the flow rate control valve 54 in the closing direction.

The response of the flow rate control valve 54 is higher than that of the EGR valve 52, i.e., the flow rate control valve 54 has a larger valve opening change per unit time. The flow rate control valve 54 will therefore be fully closed in a relatively short period of time. After the flow rate control valve 54 has been held closed for a prescribed period of time, it will again be driven in the opening direction in preparation for switching to the stratified-charge combustion.

This will be explained with reference to FIG. 9.

Figure 9A:
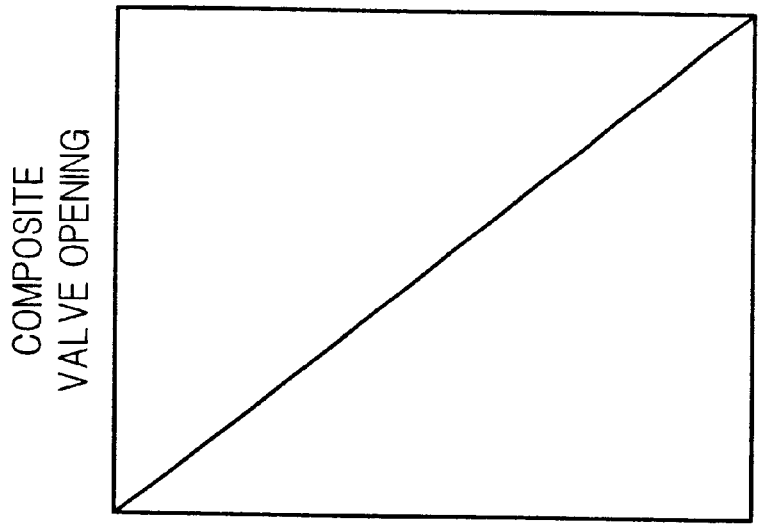
FIGS. 9A,9B, and 9C is a set of graphs showing the operation of the flow chart of FIG. 5.
Figure 9B:
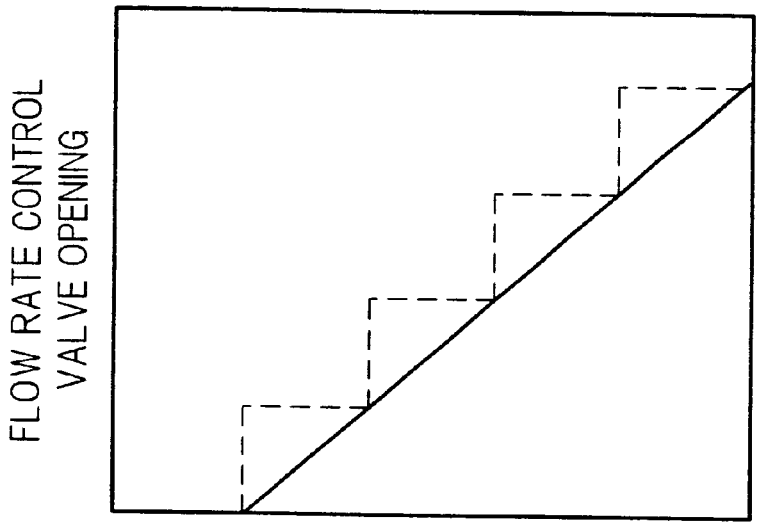
Figure 9C:
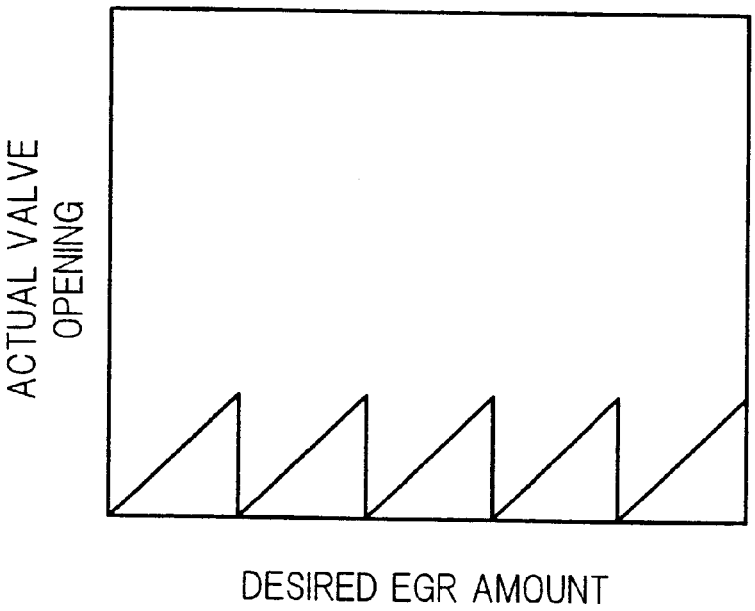

Defining the composite opening (opening area) of the EGR control valve 52 and the flow rate control valve 54 as shown in FIG. 9A and the opening (opening area) of the flow rate control valve 54 as shown in FIG. 9B, by operating the flow rate control valve 54 as shown by the broken line in FIG. 9B, it becomes possible to effect the desired EGR amount as shown in FIG. 9C.

As explained in the foregoing, the system according to this embodiment can prevent the EGR amount from becoming excessive (which would otherwise occur due to the delay in response of the EGR control valve 52), with the use of the high response flow rate control valve 54, when the combustion mode is switched from the stratified-charge combustion region in which a large amount of EGR is needed, to the premix-charge combustion region in which a relatively lesser amount of EGR amount is needed.

As a result, as shown in FIG. 8C and FIG. 8D, discharge of unburnt HCs (which would otherwise be produced by misfire) can be effectively prevented because the absence of fluctuation in combustion ensures that no misfire occurs. Moreover, the use of the flow rate control valve 54 in addition to the EGR control valve 52 makes it possible to achieve an increased EGR amount that enables the recirculated gas to be supplied as required up to the marginal limit of EGR in the stratified-charge combustion region.

Since the gist of this invention lies in an operating principle based on the mechanical configuration of the EGR mechanism and not in EGR control per se, in FIG. 8 and some of the other figures, the representation of the desired EGR amount and the like is simplified.

Figure 10:
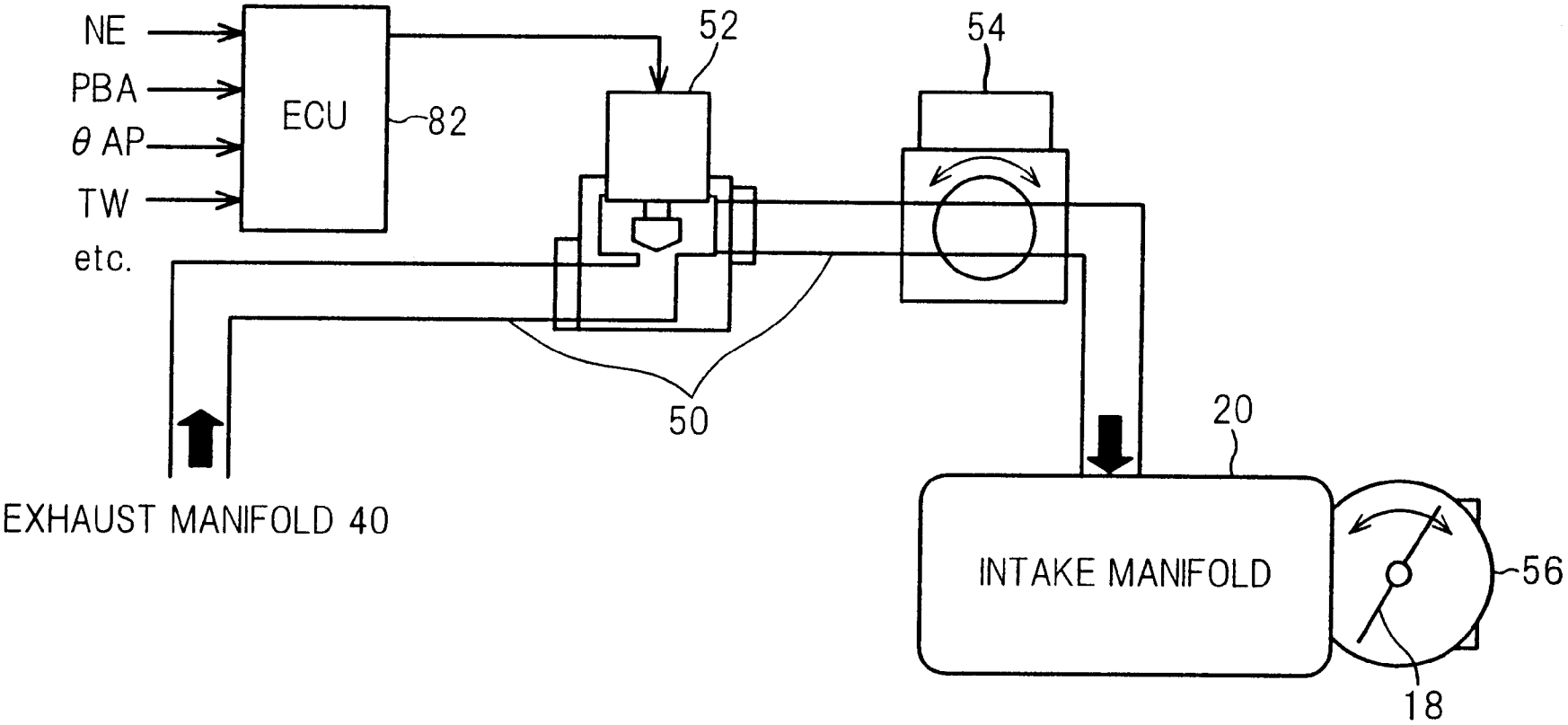
FIG. 10 is a schematic view of an EGR mechanism, similar to FIG. 2, but showing the structure of an EGR control system for an internal combustion engine according to a second embodiment of the invention.

FIG. 10 is a schematic view of an EGR mechanism, similar to FIG. 2, but showing the structure of an EGR control system for an internal combustion engine according to a second embodiment of this invention. In the system according to the second embodiment, the throttle valve 18 is controlled through the medium of the stepper motor 56.

In the case of an ordinary engine where gasoline fuel is injected before the intake valve(s), the required EGR amount is normally set so as to obtain optimum engine performance for the engine speed NE and the manifold absolute pressure PBA. The diameter (or capacity) of the EGR control valve is designed as appropriate for the possible maximum EGR amount and its lift amount is regulated when the EGR amount is smaller than the maximum value.

As was pointed out earlier, however, the stratified-charge combustion region requires a large amount of EGR and the pressure difference between the intake air pressure and the exhaust gas drops sharply in this region due to the engine operation with wide-open throttling. This leads to the problems discussed earlier.

Figure 11A:
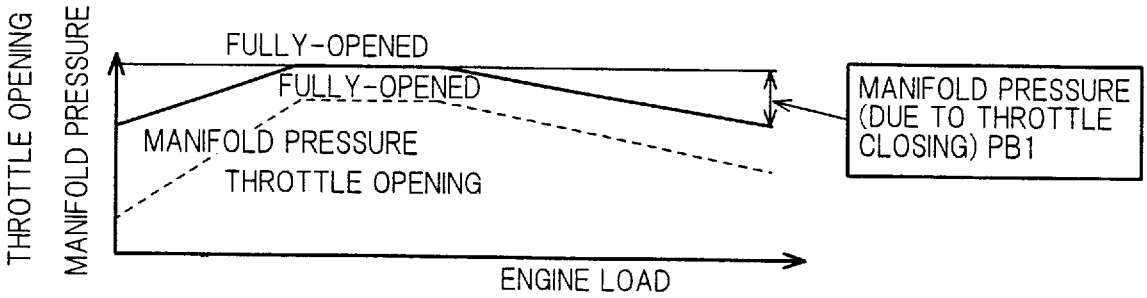
FIGS. 11A, 11B, and 11C is a set of time charts, similar to FIG. 8, but showing the operation but showing the operation of the system according to the second embodiment of the invention.
Figure 11B:
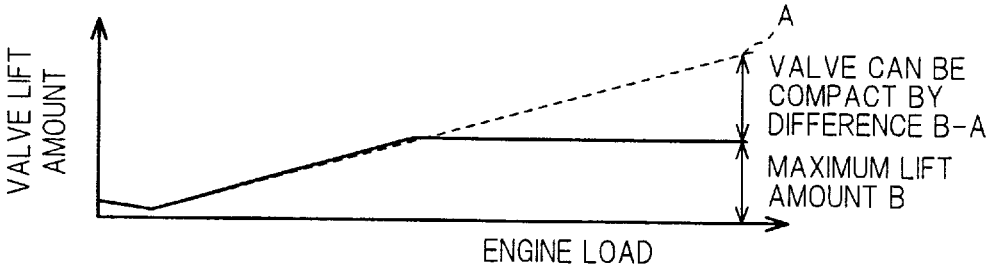
Figure 11C:
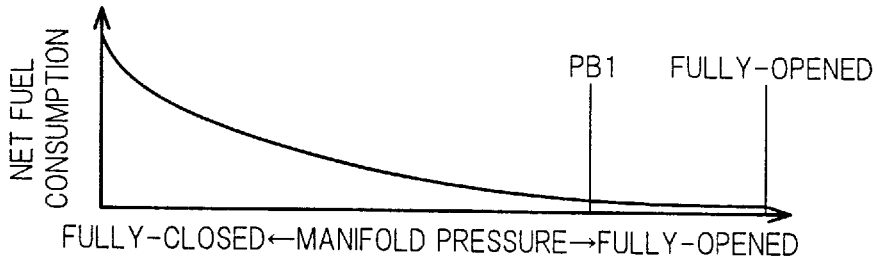

In view of this, in the system according to the second embodiment, the stepper motor 56 is controlled to drive the throttle valve 18 in the closing direction within a range of manifold pressure (illustrated as "PB1" in FIG. 11A) in which the net fuel consumption is degraded little, thereby elevating the pressure difference between the intake air pressure and the exhaust gas such that the EGR amount is increased. By this, as shown in FIGS. 11B and 11C, the lift amount of the EGR control valve 52 can be lowered, compared with the case that the foregoing control is not effected (indicated by "A" in FIG. 11B) to a level indicated by "B" in the figure. Thus, the foregoing problems can be overcome and the EGR control valve 52 can be made proportionally more compact by effecting manifold pressure control within the range B of the maximum valve lift amount.

The foregoing will be further explained with reference to FIG. 12.

Figure 12A:
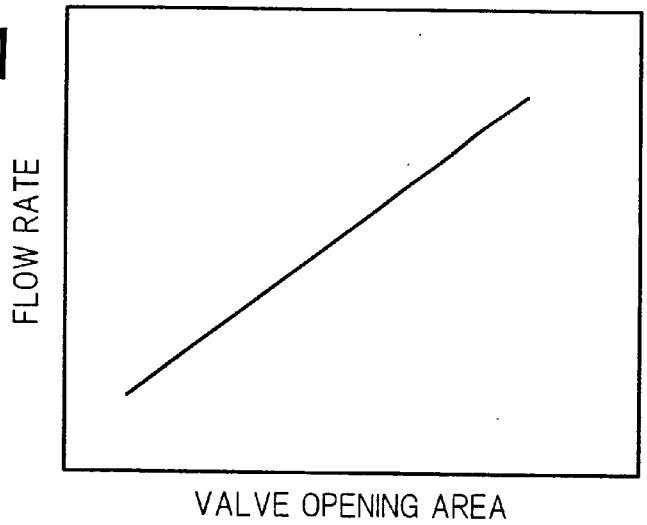
FIGS. 12A, 12B, and 12C is a set of graphs, similar to FIG. 9, but showing the operation of the system according to the second embodiment of the invention.
Figure 12B:
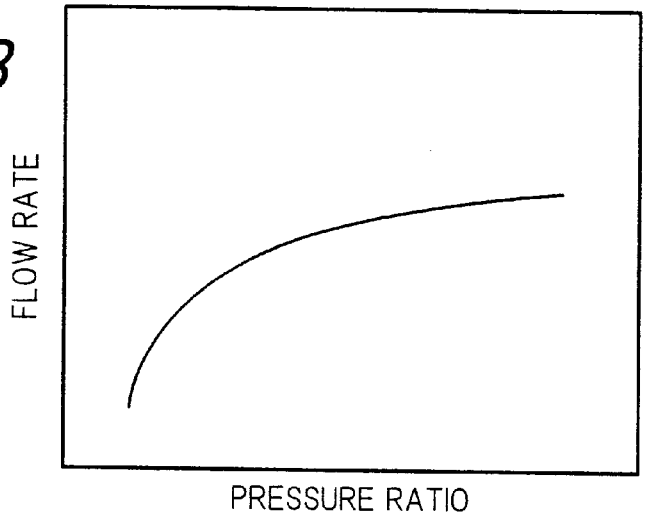
Figure 12C:
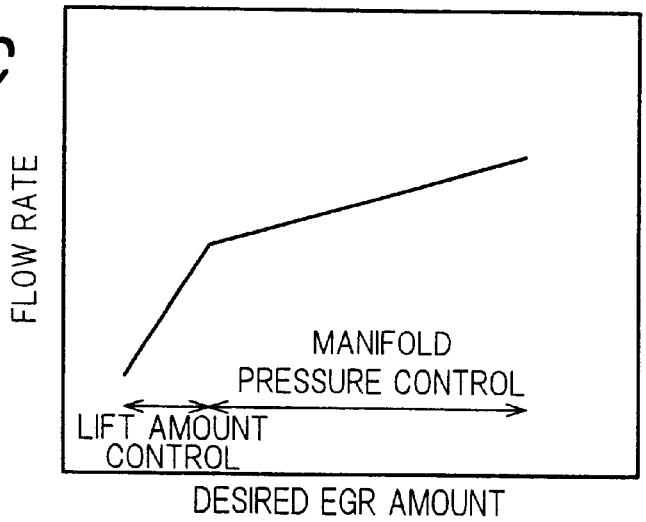

As shown in FIG. 12A, the flow rate of the EGR control valve 52 varies in proportion to the valve opening area at a constant pressure. As shown in FIG. 12B, however, its flow rate varies in proportion to the square root of the pressure at a constant valve opening. Accordingly, as shown in FIG. 11C, the desired EGR amount required can be achieved without response delay by effecting valve opening control in the low flow rate region and utilizing the throttle opening to effect manifold pressure control after the valve opening has substantially been fully-opened.

Based on the above, the operation of the system according to the second embodiment will now be explained with reference to the flow charts of FIGS. 13 and 14.

Figure 13:
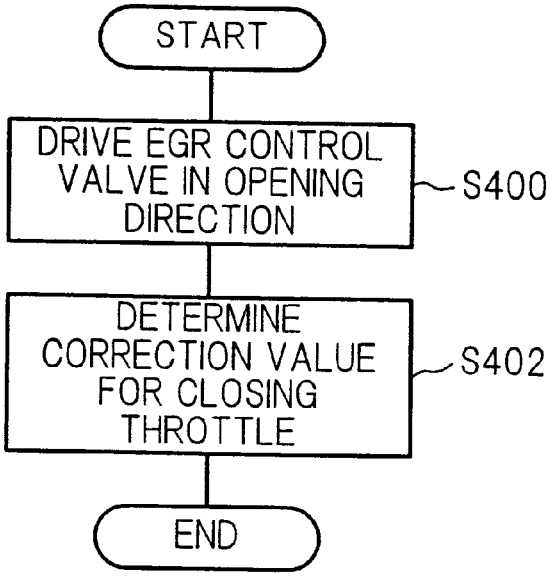
FIG. 13 is a flow chart, similar to FIG. 6, but showing the operation of the EGR control actuator for stratified-charge combustion of the system according to the second embodiment of the invention.

FIG. 13 shows a subroutine flow chart, similar to that of FIG. 6 relating to the first embodiment, showing the operation for driving the EGR control actuator for stratified-charge combustion. FIG. 14 is a subroutine flow chart, similar to that of FIG. 7 relating to the first embodiment, showing the operation for driving the EGR control actuator for premix-charge combustion.

The operation for driving the EGR control actuator for stratified-charge combustion starts with S400, in which the EGR control valve 52 is driven in the opening direction, and then proceeds to S402, in which a correction value for closing the throttle valve 18 is determined or calculated.

Figure 14:
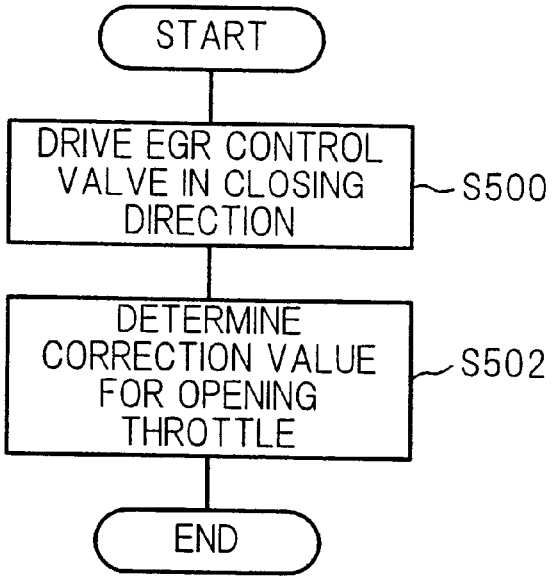
FIG. 14 is a flow chart, similar to FIG. 7, but showing the operation of the EGR control actuator for premix-charge combustion of the system according to the second embodiment of the invention.

The operation for driving the EGR control actuator for premix-charge combustion shown in the flow chart of FIG. 14 starts with S500, in which the EGR control valve 52 is driven in the closing direction, and then passes to S502, in which a correction value for opening the throttle valve 18 is determined or calculated.

The correction value calculated in S402 of the flow chart of FIG. 13 or S502 of the flow chart of FIG. 14 is used to correct the desired throttle opening in the operation conducted in S14 of the flow chart of FIG. 3 that was explained regarding the first embodiment.

Having been configured in the foregoing manner, the system according to the second embodiment can prevent combustion fluctuation and misfiring from occurring, without response delay, when the combustion mode is switched from the stratified-charge combustion in which a large EGR amount is needed to the premix-charge combustion in which a lesser EGR amount is required, thereby enabling to prevent unburnt HCs (which would otherwise be produced by misfire) from being discharged. Further, if an existing stepper motor (actuator) can be utilized, this makes the system configuration simpler. Furthermore, the system can make EGR control valve 52 compact.

Figure 15:
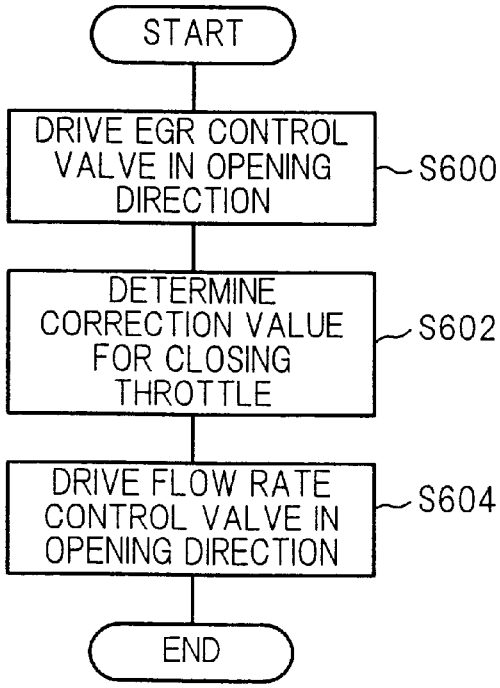
FIG. 15 is a flow chart, similar to FIG. 6, but showing the operation of the EGR control actuator for stratified-charge combustion of the system according to a third embodiment of the invention.
Figure 16:
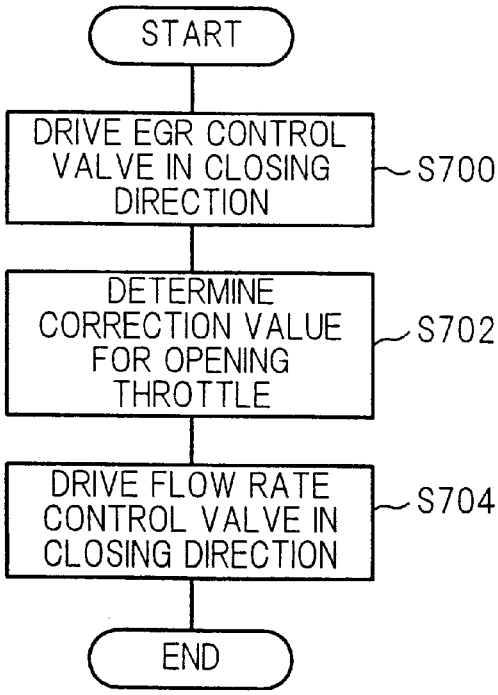
FIG. 16 is a flow chart, similar to FIG. 7, but showing the operation of the EGR control actuator for premix-charge combustion of the system according to the third embodiment of the invention.

FIGS. 15 and 16 show the operation of an EGR control system for an internal combustion engine according to a third embodiment of this invention in which FIG. 15 is a subroutine flow chart, similar to that of FIG. 13 regarding the second embodiment, showing the operation for driving the EGR control actuator for stratified-charge combustion and FIG. 16 is a subroutine flow chart, similar to that of FIG. 14 regarding the second embodiment, showing the operation for driving the EGR control actuator for premix-charge combustion.

In the flow chart of FIG. 15, the operation for driving the EGR control actuator for stratified-charge combustion starts with S600, in which the EGR control valve 52 is driven in the opening direction, proceeds to S602, in which a correction value for closing the throttle valve 18 is determined or calculated, and proceeds to S604, in which the flow rate control valve 54 is driven in the opening direction.

In the flow chart of FIG. 16, the operation for driving the EGR control actuator for premix-charge combustion starts with S700, in which the EGR control valve 52 is driven in the closing direction, proceeds to S702, in which a correction value for opening the throttle valve 18 is determined or calculated, and proceeds to S704, in which the flow rate control valve 54 is driven in the closing direction.

The third embodiment thus amounts to a merging of the first and second embodiments. Specifically, it is configured by adding the flow rate control valve control of the first embodiment to the throttle opening control of the second embodiment.

Having been configured in the foregoing manner, the system according to the third embodiment can prevent response delay from happening more effectively such that the occurrence of combustion fluctuation and misfire can be prevented more effectively, when the combustion mode is switched from the stratified-charge combustion in which a large EGR amount is need to the premix-charge combustion in which a lesser EGR amount is required.

Figure 17:
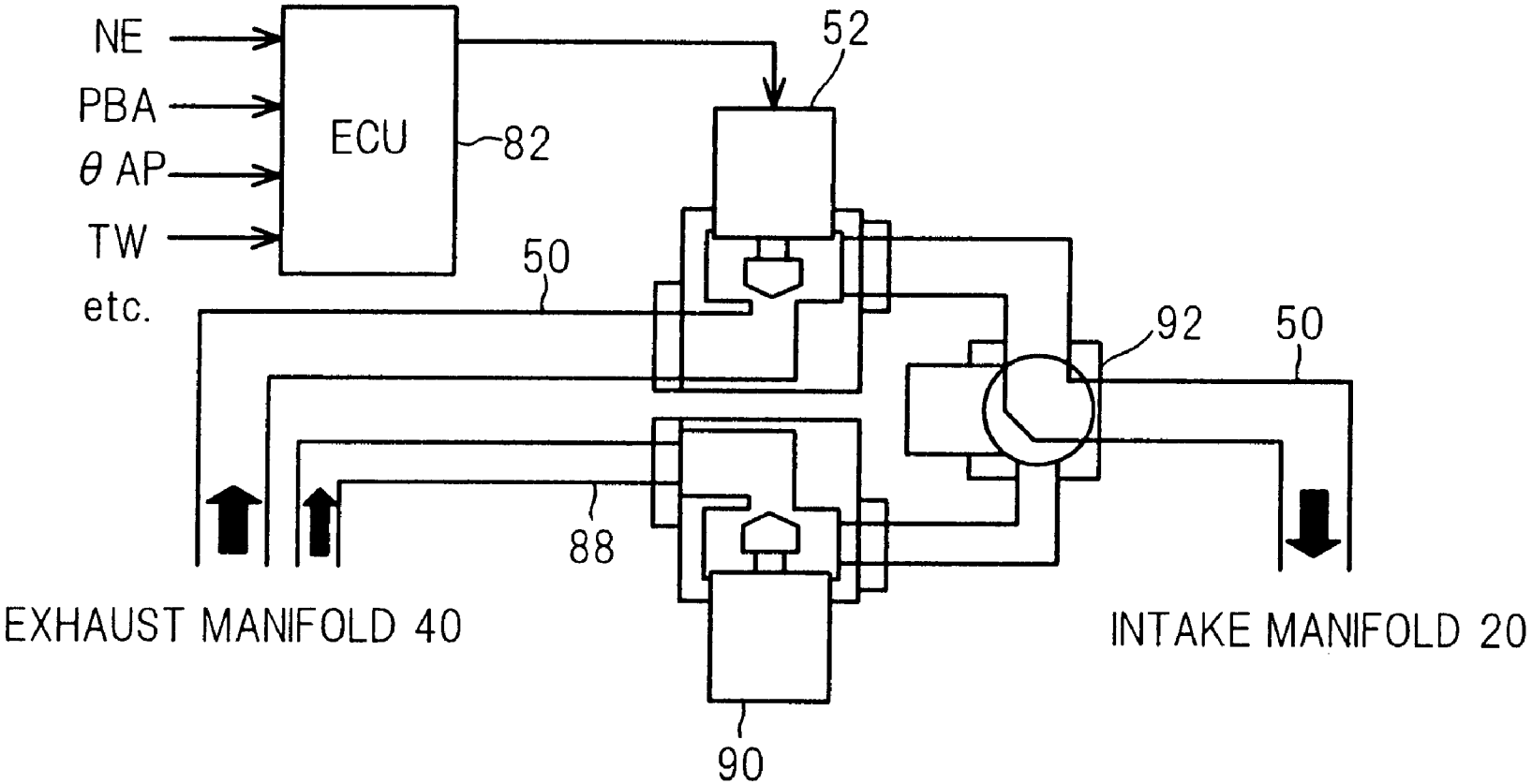
FIG. 17 is a schematic view of an EGR mechanism, similar to FIG. 2, but showing the structure of an EGR control system for an internal combustion engine according to a fourth embodiment of the invention.

FIG. 17 is a schematic view of an EGR mechanism, similar to FIG. 2, but showing the structure of an EGR control system for an internal combustion engine according to a fourth embodiment of this invention.

As illustrated, in the system according to the fourth embodiment, a branch passage 88 is provided which is branched from the EGR passage 50 to join the exhaust manifold 40, more precisely with a branch point of the EGR passage 50 located downstream (in the EGR gas flow) of the EGR control valve 52. A second EGR control valve 90 is installed in the branch passage 88 and a passage switching valve 92 is provided at the branch point, i.e., at a point downstream of the EGR control valve 52 and the second EGR control valve 90, so as to regulate the amount of the exhaust to be recirculated. In other words, a plurality of EGR control valves, more precisely two EGR control valves 52 and 90 are disposed parallel to one another, and one is selected for use by operating the passage switching valve 92.

The systems according to the first to third embodiments can effectively prevent the EGR amount from becoming excessive when the combustion mode is switched from the stratified-charge combustion to the premix-charge combustion. However, they are not always effective in preventing the degradation of exhaust gas composition and fuel consumption caused by the EGR amount deficiency due to the EGR control valve response delay at the time of switching from the premix-charge combustion region to the stratified-charge combustion region.

In the system according to the fourth embodiment, accordingly, the diameter (or capacity) of the EGR control valve 52 is made large enough to ensure supply of the maximum EGR amount possibly required in the stratified-charge combustion region and the diameter (or capacity) of the second EGR control valve 90 is made large enough to ensure supply of the maximum EGR amount possibly required in the premix-charge combustion region.

In other words, the diameter of the second EGR control valve 90 is designed to be smaller than the diameter of the EGR control valve 52, meaning that the response of the second EGR control valve 90 is higher than that of the EGR control valve 52. In light of the difference in valve diameter, moreover, the branch passage 88 is designed to have a smaller diameter than that of the EGR passage 50. The two types of EGR control valves 52 and 90 are thus disposed parallel to one another and the passage switching valve 92 is operated to select one in response to the determined combustion mode (combustion region) so as to recirculate EGR gas into the air intake system through either the EGR passage 50 or the branch passage 88. The switching valve 92 is selected to have high response.

Figure 18:
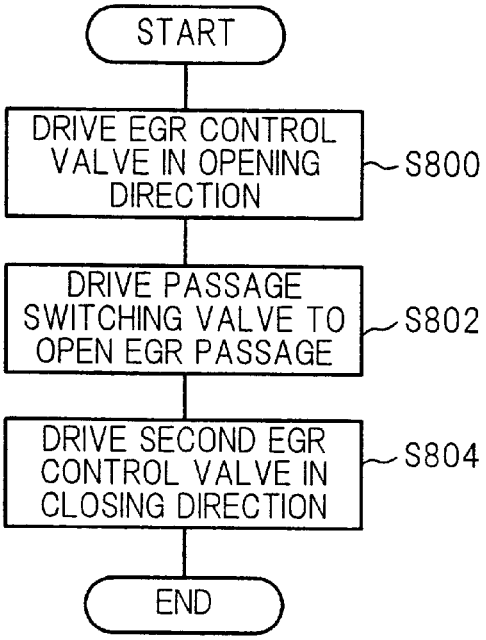
FIG. 18 is a flow chart, similar to FIG. 15, but showing the operation of the EGR control actuator for stratified-charge combustion of the system according to the fourth embodiment of the invention.
Figure 19:
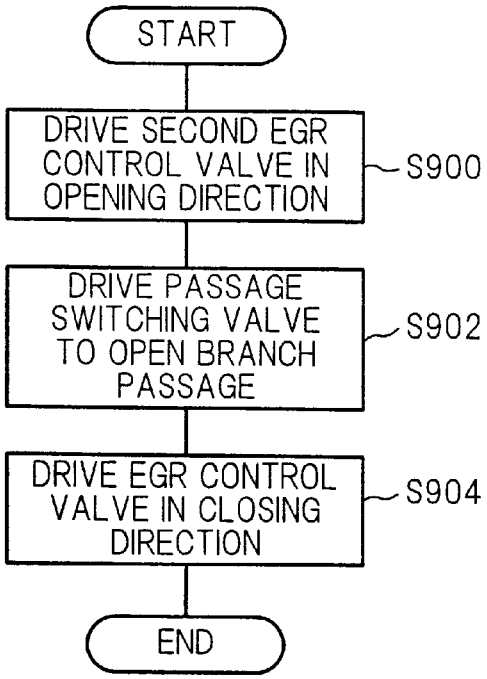
FIG. 19 is a flow chart, similar to FIG. 16, but showing the operation of the EGR control actuator for premix-charge combustion of the system according to the fourth embodiment of the invention.

FIGS. 18 and 19 show the operation of the system according to the fourth embodiment of this invention in which FIG. 18 is a subroutine flow chart, similar to that of FIG. 13 regarding the second embodiment, showing the operation for driving the EGR control actuator for stratified-charge combustion and FIG. 16 is a subroutine flow chart, similar to that of FIG. 14 regarding the second embodiment, showing the operation for driving the EGR control actuator for premix-charge combustion.

The flow charts of FIGS. 18 and 19 will now be explained with reference also to a time chart of FIG. 20.

Figure 20A:
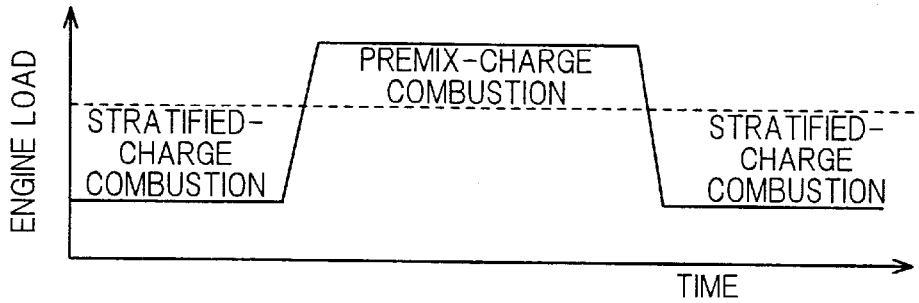
FIGS. 20A, 20B, 20C, and 20D is a set of time charts, similar to FIG. 8, but showing the operation of the system according to the fourth embodiment of the invention.
Figure 20B:
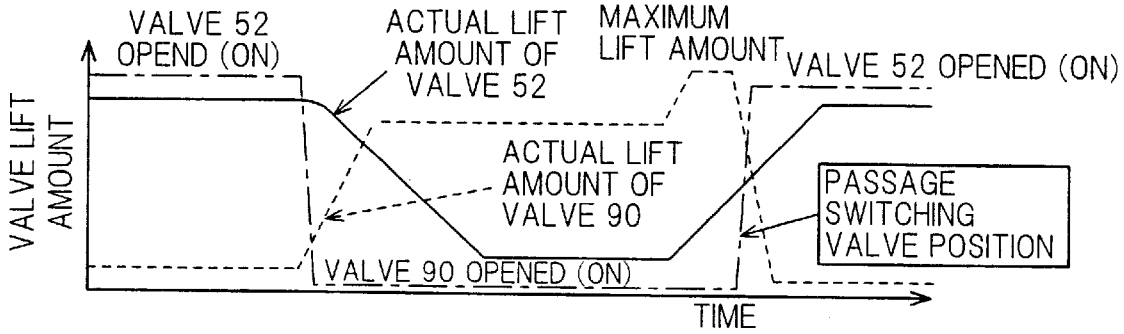

The operation for driving the EGR control actuator for stratified-charge combustion starts with S800, in which the relatively large capacity EGR control valve 52 is driven in the opening direction, proceeds to S802, in which the passage switching valve 92 is driven to the side of the large capacity EGR valve 52, i.e., so as to open the EGR passage 50, and proceeds to S804, in which the relatively small capacity second EGR control valve 90 is driven in the closing direction (as shown in FIGS. 20A and 20B).

The operation for driving the EGR control actuator for premix-charge combustion shown in the flow chart of FIG. 19 starts with S900, in which the second EGR control valve 90 is driven in the opening direction, proceeds to S902, in which the passage switching valve 92 is driven to the side of the small capacity EGR control valve 90, i.e., so as to open the branch passage 88, and proceeds to S904, in which the EGR control valve 52 is driven in the closing direction (as shown in FIGS. 20A and 20B).

Figure 20C:
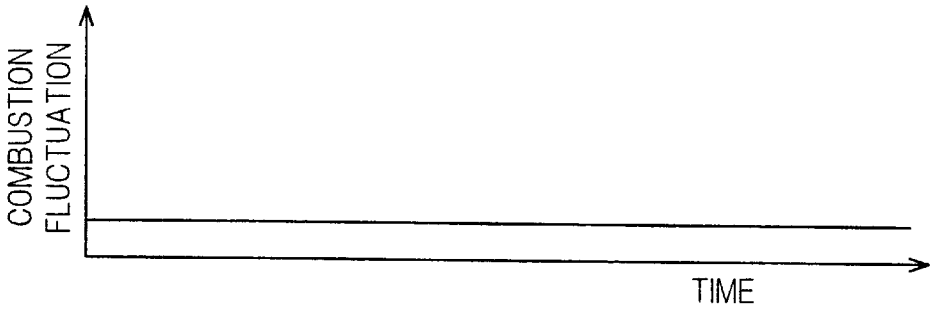
Figure 20D:
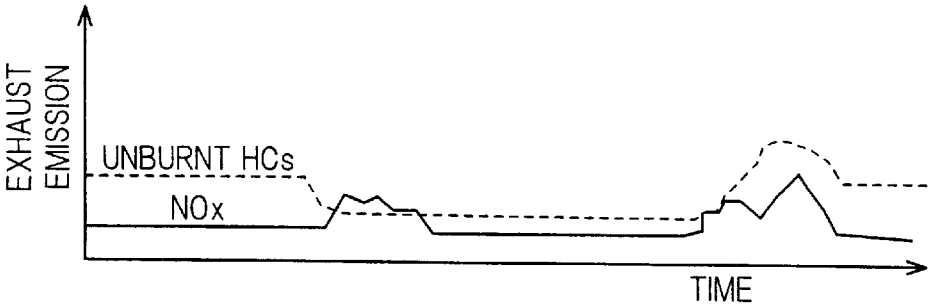

In the system according to the fourth embodiment, since the high response passage switching valve 92 closes the EGR passage 50 when the combustion mode is switched from the stratified-charge combustion to the premix-charge combustion, no response delay arises. As a result, as shown in FIGS. 20C and 20D, the system can suppress combustion fluctuation and can improve emission performance.

Further, when the combustion mode is switched from the premix-charge combustion to the stratified-charge combustion, the high response second EGR control valve 90 is fully opened when the driving of the large and low response EGR control valve 52 in the opening direction is commenced. In other words, the passage switching valve 92 is controlled such that both the EGR control valve 52 and the second EGR control valve 90 operate until the flow rate of the EGR control valve 52 exceeds the flow rate of the second EGR control valve 90. With this, the response during transition to the stratified-charge combustion region can be enhanced, thereby improving the emission performance and fuel economy performance at this time.

Owing to the aforesaid configuration, the system according to the fourth embodiment can achieve the same effects as explained with regard to the earlier embodiments and, in addition, can achieve improvements in emission performance and fuel economy performance during transition from the premix-charge combustion to the stratified-charge combustion.

Figure 21:
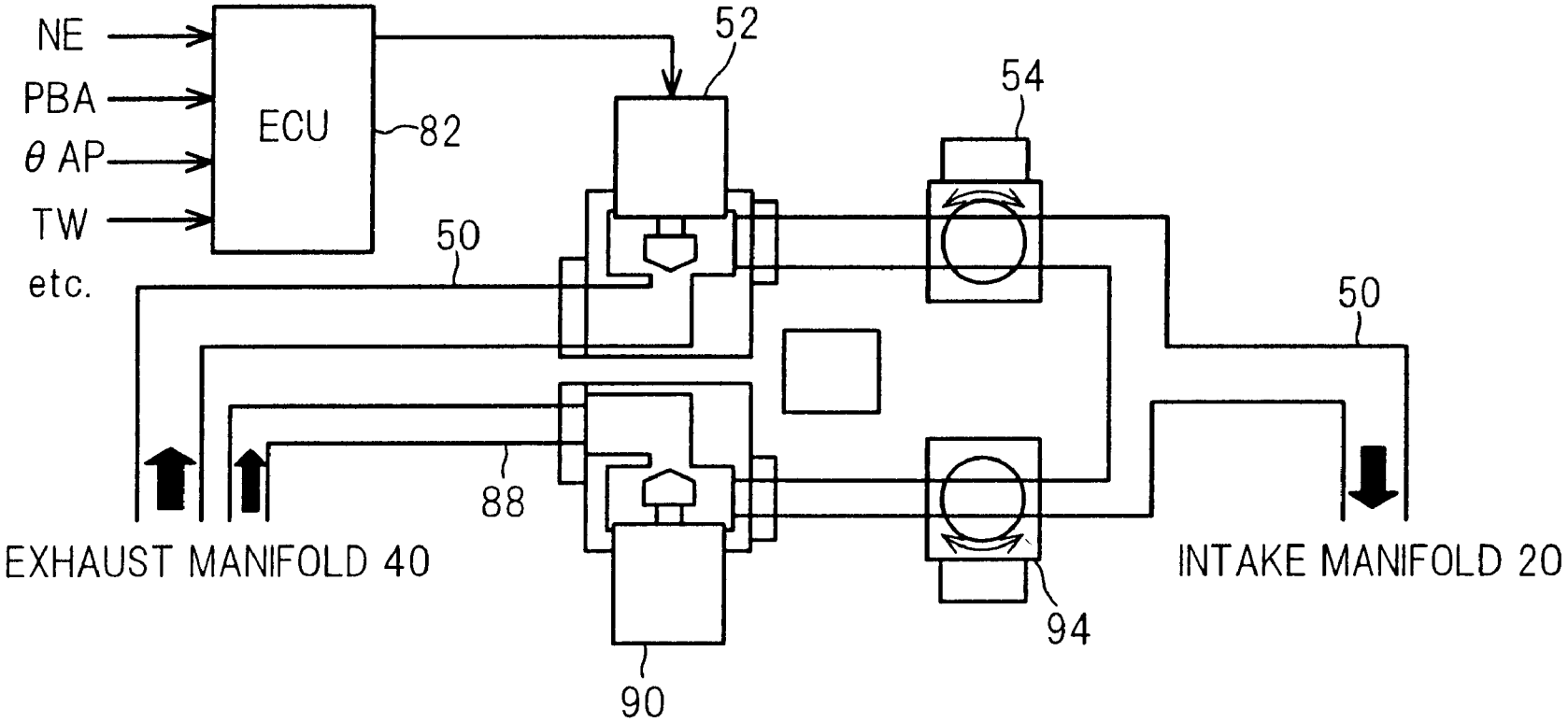
FIG. 21 is a schematic view of an EGR mechanism, similar to FIG. 2, but showing the structure of an EGR control system for an internal combustion engine according to a fifth embodiment of the invention.

FIG. 21 is a schematic view of an EGR mechanism, similar to FIG. 2, but showing the structure of an EGR control system for an internal combustion engine according to a fifth embodiment of this invention.

As illustrated, in the system according to the fifth embodiment, the branch passage 88 is similarly provided to join the exhaust manifold 40 with the branch point of the EGR passage 50 located downstream (in the EGR gas flow) of the EGR control valve 52 and the second EGR control valve 90 is installed in the branch passage 88. In these aspects, the system according to the fifth embodiment is similar to that of the fourth embodiment. As in the first to third embodiments, the flow rate control valve 54 is installed in the EGR passage 50 downstream (in the EGR gas stream) of the EGR control valve 52. Further, a second flow rate control valve 94 is installed in the branch passage 88 downstream of the second EGR control valve 90 to regulate the flow rate of the exhaust gas to be recirculated.

In the fourth embodiment explained above, if the diameters (capacities) of the EGR control valves 52 and 90 are quite different, the EGR amount tends to be deficient, despite the provision of the two types of EGR control valves, during the period from the time point at which the maximum flow rate of the small diameter second EGR control valve 90 and the maximum flow rate of the EGR control valve 52 become equal to the time point at which the desired lift amount is achieved.

In order to overcome this problem, the system according to the fifth embodiment is provided with separate flow rate control valves 54 and 94 associated with each EGR control valve. When the combustion mode is switched from the premix-charge combustion to the stratified-charge combustion, the EGR control valve 52 and the second EGR control valve 94 are used simultaneously to reduce the response delay and thus minimize EGR amount deficiency during the transition.

Also in the system according to the fifth embodiment, the diameter (capacity) of the EGR control valve 52 is made large enough to ensure supply of the maximum EGR amount required in the stratified combustion region and the diameter of the second EGR control valve 90 is made large enough to ensure supply of the maximum EGR amount required in the premix combustion region. In light of the difference in valve diameter, the branch passage 88 is given a smaller diameter than that of the EGR passage 50. Moreover, the flow rate control valves 54, 94 are selected to have higher responses than the EGR control valve 52 and second EGR control valve 90.

Figure 22:
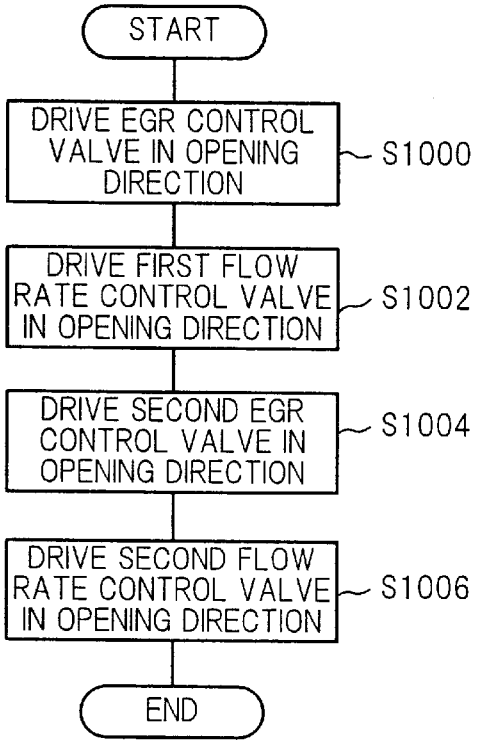
FIG. 22 is a flow chart, similar to FIG. 18, but showing the operation of the EGR control actuator for stratified-charge combustion of the system according to the fifth embodiment of the invention.
Figure 23:
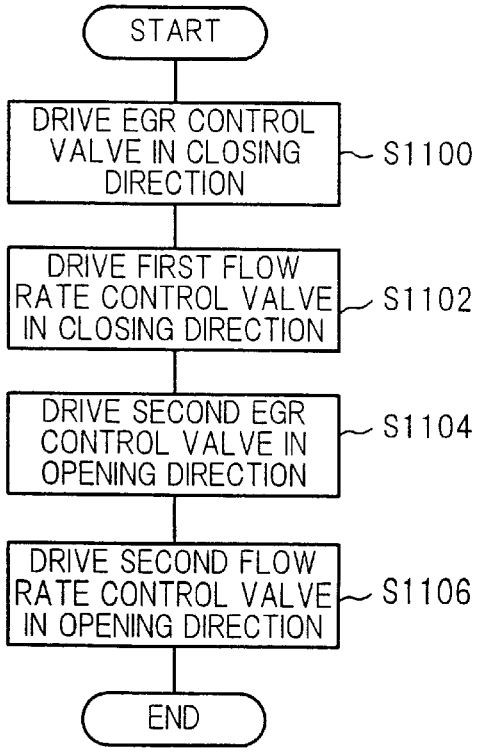
FIG. 23 is a flow chart, similar to FIG. 19, but showing the operation of the EGR control actuator for premix-charge combustion of the system according to the fifth embodiment of the invention.

FIGS. 22 and 23 show the operation of the system according to the fifth embodiment of this invention. FIG. 22 is a subroutine flow chart, similar to that of FIG. 18 regarding the fourth embodiment, showing the operation for driving the EGR control actuator for the stratified-charge combustion. FIG. 23 is a subroutine flow chart, similar to that of FIG. 19 regarding the fourth embodiment, showing the operation for driving the EGR control actuator for premix-charge combustion.

The flow charts of FIGS. 22 and 23 will now be explained with reference also to a time chart of FIG. 24.

The operation for driving the EGR control actuator for the stratified-charge combustion starts with S1000, in which the large capacity EGR control valve 52 is driven in the opening direction, proceeds to S1002, in which the first flow rate control valve 54 is driven in the opening direction, proceeds to S1004, in which the small capacity second EGR control valve 90 is driven in the opening direction, and proceeds to S1006, in which the second flow rate control valve 94 is driven in the opening direction. Thus all four valves arc driven in the opening direction (as shown in FIGS. 24A, 24B and 24C).

The operation for driving the EGR control actuator for the premix-charge combustion shown in the flow chart of FIG. 23 starts with S1100, in which the EGR control valve 52 is driven in the closing direction, proceeds to S1102, in which the first flow rate control valve 54 is driven in the closing direction, proceeds to S1104, in which the second EGR control valve 90 is driven in the opening direction, and proceeds to S1106, in which the second flow rate control valve 94 is driven in the opening direction. Thus two of four valves are driven in the closing direction and the other two are driven in the opening direction.

Figure 24A:
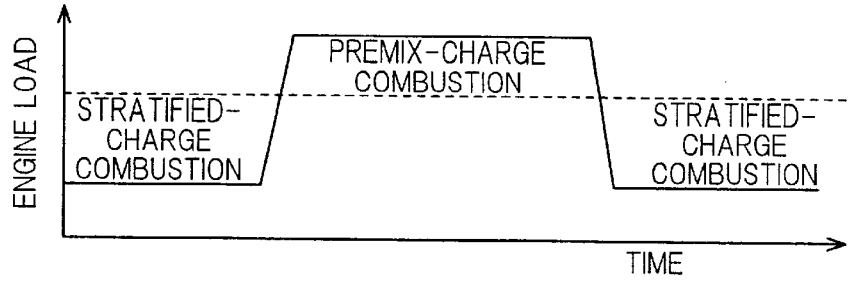
FIGS. 24A, 24B, 24C, 24D, and 24E is a set of time charts, similar to FIG. 20, but showing the operation of the system according to the fifth embodiment of the invention.
Figure 24B:
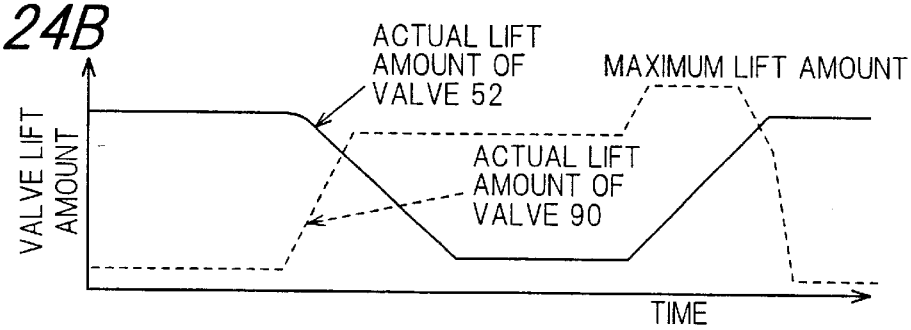
Figure 24C:
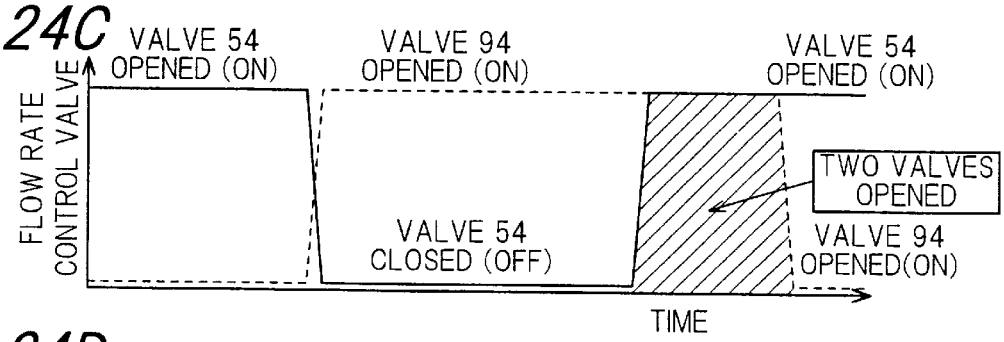
Figure 24D:
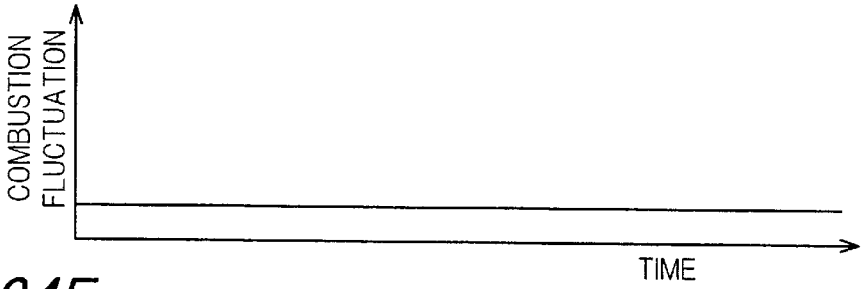
Figure 24E:
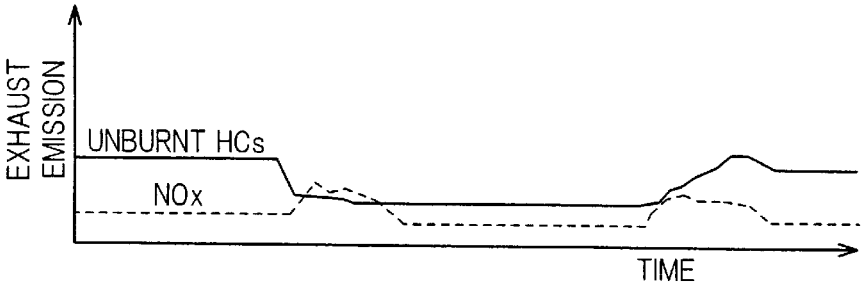

In the fifth embodiment, since the high response flow rate control valve 54 closes the EGR passage 50 when the combustion mode is switched from the stratified-charge combustion to the premix-charge combustion (as shown in FIGS. 24A and 24B), no response delay arises. As shown in FIGS. 24C, 24D and 24E, combustion fluctuation can be suppressed and emission performance improved. When the combustion mode is switched from the premix-charge combustion to the stratified-charge combustion, all four valves are controlled in the opening direction and, therefore, as shown in FIGS. 24C, 24D and 24E, the response during transition can be increased to improve the emission performance and fuel economy performance.

Figure 25:
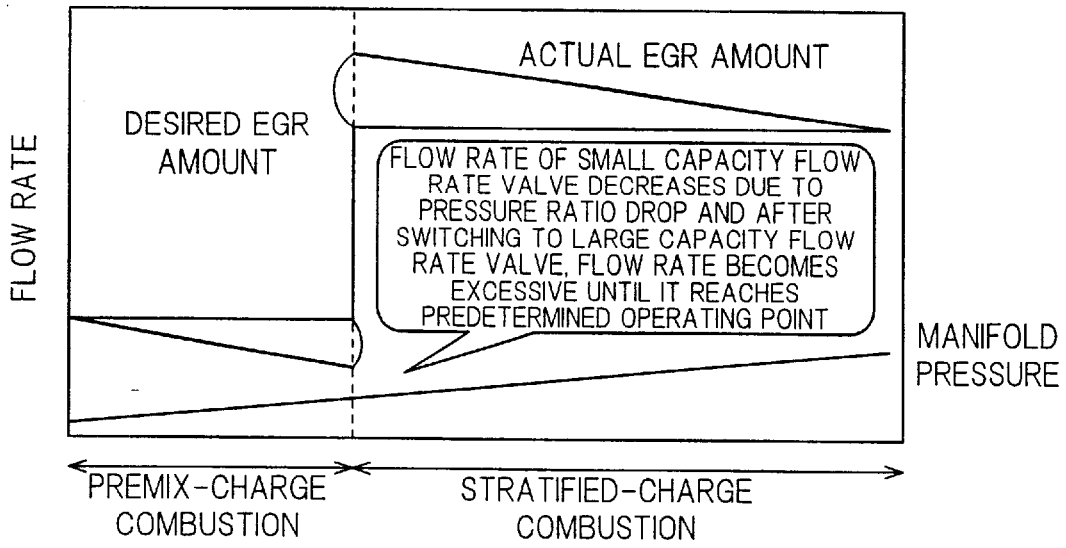
FIG. 25 is a graph showing the operation of the system according to the fifth embodiment of the invention.
Figure 26:
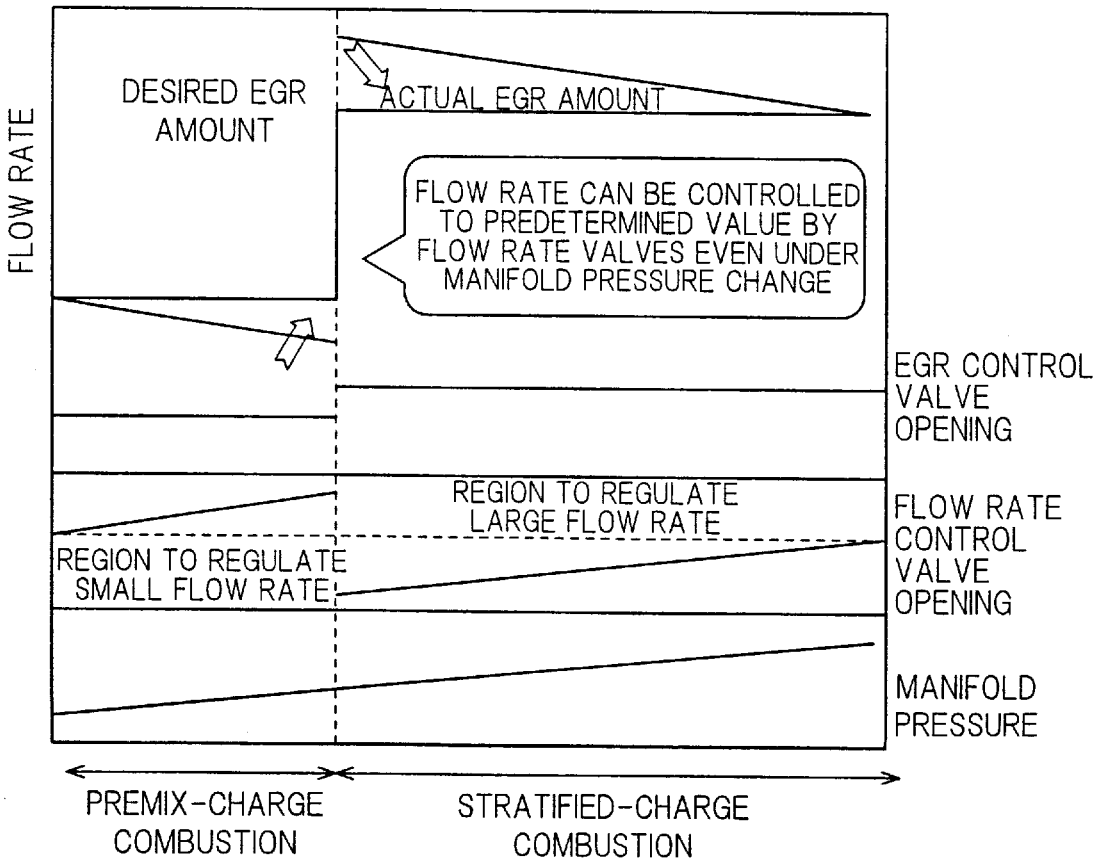
FIG. 26 is a graph similarly showing the operation of the system according to the fifth embodiment of the invention.
Figure 27:
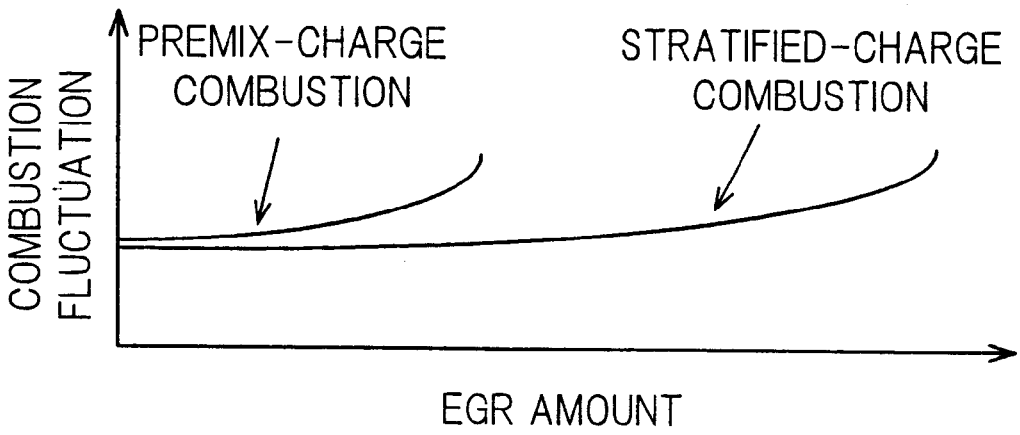
FIG. 27 is a graph showing the combustion fluctuation relative to the EGR amount in the two combustion modes comprising the stratified charge combustion and the premix-charge combustion.
Figure 28:
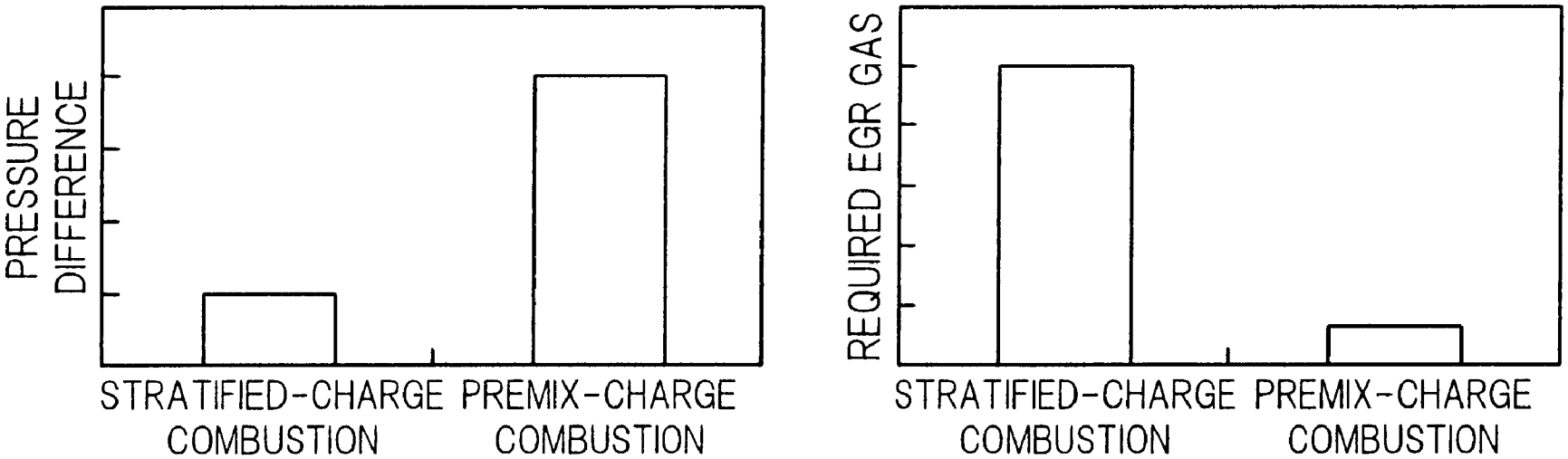
FIG. 28 is a set of graphs showing the pressure difference between the intake air pressure and the exhaust gas pressure and required EGR amount relative to the combustion modes.
Figure 29A:
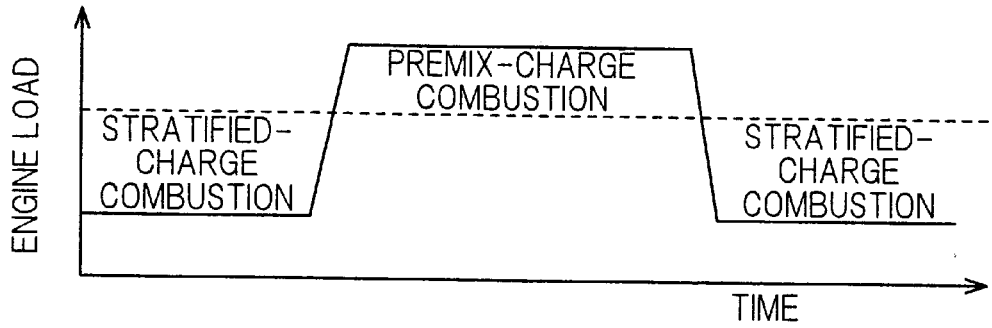
FIGS. 29A, 29B, 29C, and 29D is a set of time charts showing the operation of a prior art system for an engine having the two combustion modes.
Figure 29B:
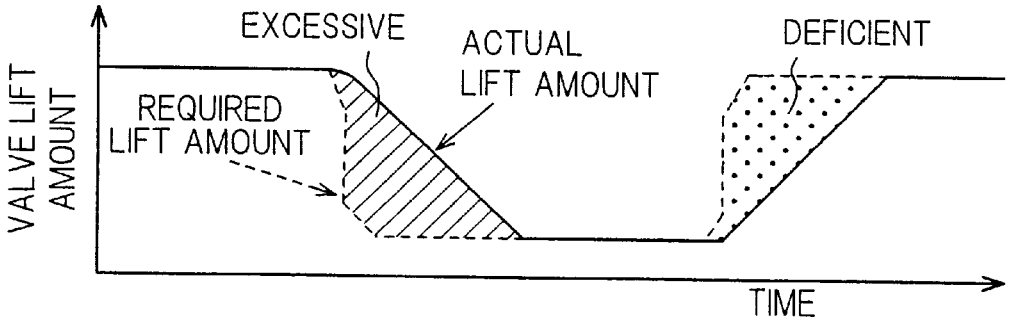
Figure 29C:
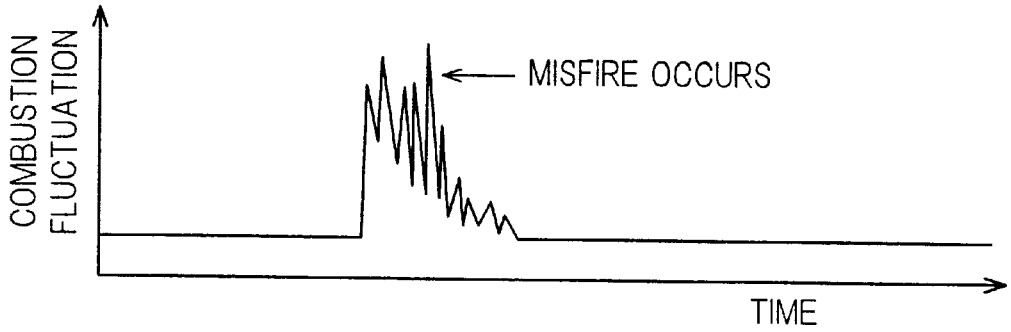
Figure 29D:
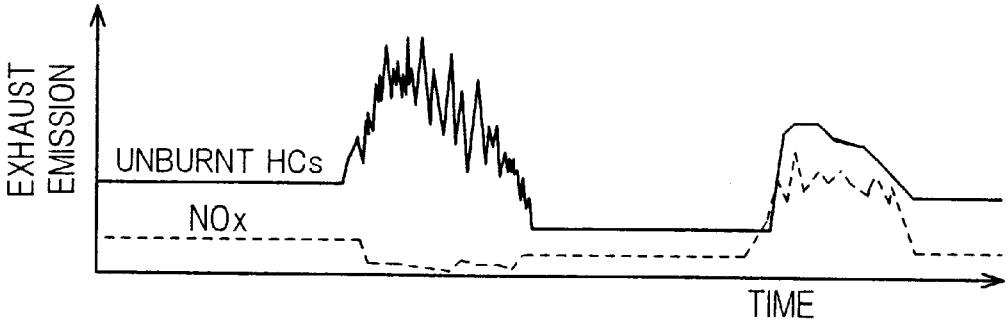

Comparing the fifth embodiment with the fourth embodiment, as shown in FIG. 25, in the earlier fourth embodiment, the transition from the premix-charge combustion to the stratified-charge combustion is accompanied by large variation in EGR amount owing to the variation in the amount of air intake, making it necessary to control the valve openings with consideration to pressure change. On the other hand, as shown in FIG. 26, in the fifth embodiment, the provision of the flow rate control valves 54 and 94 downstream of the EGR control valve 52 and the second EGR valve 90 makes it possible to establish a prescribed relationship between the EGR flow rate and the openings (opening areas) that is unaffected by the manifold pressure. The response during transition from the premix-charge combustion to the stratified-charge combustion is accordingly enhanced.

Owing to the aforesaid configuration, the system according to the fifth embodiment can achieve the same effects as explained with regard to the fourth embodiment. In addition, it upgrades response during transition from the premix-charge combustion to the stratified-charge combustion and can therefore achieve still greater improvements in emission performance and fuel economy performance at such times.

The first to fifth embodiments are thus configured to have a system for controlling an EGR mechanism, installed in an internal combustion engine (10), having an EGR passage (50) connecting an air intake system (40) and an exhaust system (12) of the engine (10) to recirculate a portion of exhaust gas produced by the engine to the air intake system and an EGR control valve (52) equipped at the EGR passage (50) to regulate an amount of the exhaust gas to be recirculated; including; engine operating condition detecting means (62, 66, 82, S10) for detecting operating conditions of the engine (10); combustion mode determining means (82, S12) for determining one of a plurality of combustion modes of the engine (10) based on the detected operating conditions of the engine; and EGR mechanism operating means (82, S20) for operating an EGR control valve (52) of the EGR mechanism based on the detected operating conditions of the engine. The system includes at least one of a flow rate control valve (54) equipped at the EGR passage to regulate flow rate of the exhaust gas to be recirculated and an actuator (56) for regulating an opening of a throttle valve (18) provided at the air intake system (12); and the EGR mechanism operating means (80, S14, S20, S100–S112, S200–S202, S300–S302, S400–S402, S500–S502, S600–S604, S700–S704, S800–S804, S900–S904, S1000–S1006, S1100–S1106) operates the EGR control valve and at least one of the flow rate control valve and the actuator, when the one combustion mode is determined to be changed to other of a plurality of the combustion modes. The flow rate control valve (54) has a response which is higher than that of the EGR control valve (52).

With this, the most recent parameters possible can be used. The flow rate control valve having higher response than the EGR control valve is provided in the EGR passage and, at the time of a switch between combustion modes, the EGR mechanism is operated by controlling the openings of the EGR control valve and the flow rate control valve. An improved EGR control system for an internal combustion engine is thus provided that, in an engine having different combustion modes, enables realization of an EGR amount that is neither deficient nor excessive for the combustion mode, prevents misfire, and prevents degradation of drivability, fuel economy, and emission performance.

Further, when the actuator is provided for regulating the throttle opening of the engine such that, at the time of switching between combustion modes, the EGR mechanism is operated by controlling the opening of the EGR control valve and driving the actuator, which is, for example, a stepper motor. An improved EGR control system for an internal combustion engine is thus provided that, in an engine having different combustion modes, enables realization of the EGR amount that is neither deficient nor excessive for the combustion mode, prevents misfire, and prevents degradation of drivability, fuel economy, and emission performance. When an existing actuator can be utilized, the system also becomes structurally simple.

In the system, the EGR mechanism operating means operates the EGR control valve and the flow rate control valve, when the one combustion mode is determined to be changed to the other (82, S14, S20, S100–S112, S200–S202, S300–S304).

With this, the effects enumerated with regard to the foregoing can be added to those enumerated with regard to the first aspect. As a result, it is possible still more effectively to realize the EGR amount that is neither deficient nor excessive for the combustion mode, preventing misfire, and preventing degradation of drivability, fuel economy and emission performance.

In the system, the EGR mechanism further includes: a branch passage (88) branched from the EGR passage (50) to join the exhaust system (40); a second EGR control valve (90) installed in the branch passage (88) to regulate an amount of the exhaust gas to be recirculated; and a passage switching valve (92) for switching the EGR passage and the branch passage; and the EGR mechanism operating means operates the passage switching valve such that one of the EGR control valve and the second EGR control valve is selected to be operated, when the one combustion mode is determined to be changed to the other (82, S20, S100–S112, S100–S112, S800–S804, S900–S904).

With this, at the time of switching between combustion modes, the aforesaid EGR mechanism operating means operates the EGR mechanism by selectively opening/closing one or the other of the EGR control valve and the second EGR control valve. Therefore, in addition to the effects enumerated with regard to the first aspect of the invention, it is also possible to prevent the aforesaid problems by switching between different combustion modes, more specifically, when switching to either stratified-charge combustion or premix-charge combustion.

In the system, the EGR mechanism further includes: a branch passage (88) branched from the EGR passage (50) to join the exhaust system (40); a second EGR control valve (90) equipped at the branch passage (88) to regulate the amount of the exhaust gas to be recirculated; and a second flow rate control valve (94) installed in the branch passage (88) to regulate flow rate of the exhaust gas to be recirculated; and the EGR mechanism operating means selectively operates at least one of the EGR control valve, the flow rate control valve, the second EGR control valve and the second flow rate control valve, when the one combustion mode is determined to be changed to the other (82, S20, S100–S112, S1000–S1106, S1100–S1106).

With this, at the time of switching between the combustion modes, the EGR mechanism is operated by selectively controlling the openings of the set comprising the EGR control valve and first flow rate control valve and/or the set comprising of the second EGR control valve and second flow rate control valve. As a result, in addition to the effects enumerated with regard to the fourth aspect of the invention, it is also possible to prevent the aforesaid problems even if the diameters of the two types of EGR control valves are very different.

In the system, the EGR mechanism operating means selectively operates at least one of a set of the EGR control valve (52) and the flow rate control valve (54), and a set of the second EGR control valve (90) and the second flow rate control valve (94), when the one combustion mode is determined to be changed to the other (82, S20, S100–S112, S1000–S1006, S1100–S1106).

In the system, the flow rate control valve (64) is equipped at the EGR passage (50) downstream of the EGR control valve (52) in terms of the exhaust gas flow to be recirculated.

In the system, the second flow rate control valve (94) is equipped at the branch passage (88) downstream of the second EGR control valve (90) in terms of the exhaust gas flow to be recirculated.

In the system, the engine (10) is a direct injection spark ignition engine operated at a plurality of the combustion modes comprising stratified-charge combustion and premix-charge combustion.

In the system, the EGR mechanism operating means operates the EGR control valve (52), the flow rate control valve (54) and the actuator (56), when the one combustion mode is determined to be changed to the other (80, S14, S20, S100–S112, S600–S604, S700–S704).

In the system, the actuator is a stepper motor (56) which regulates the opening of the throttle valve such that a pressure difference between the air intake system (12) and the exhaust system (40) increases.

Although this invention was explained taking a direct-injection spark ignition engine as an example, it is also appropriate for application in a case where lean-bum control is conducted on an ordinary engine (where fuel is injected before the intake valve(s)).

While the invention has thus been shown and described with reference to specific embodiments, it should be noted that the invention is in no way limited to the details of the described arrangements but changes and modifications may be made without departing from the scope of the appended claims.

What is claimed is:

1. A system for controlling an EGR mechanism, installed in an internal combustion engine, having an EGR passage connecting an air intake system and an exhaust system of the engine to recirculate a portion of exhaust gas produced by the engine to the air intake system and an EGR control valve equipped at the EGR passage to regulate an amount of the exhaust gas to be recirculated; comprising;

engine operating condition detecting means for detecting operating conditions of the engine;

combustion mode determining means for determining one of a plurality of combustion modes of the engine based on the detected operating conditions of the engine; and EGR mechanism operating means for operating an EGR control valve of the EGR mechanism based on the detected operating conditions of the engine;

wherein the system includes a flow rate control valve equipped at the EGR passage to regulate flow rate of the exhaust gas to be recirculated; and the EGR mechanism operating means operates the EGR control valve and the flow rate control valve, when the one combustion mode is determined to be changed to other of a plurality of the combustion modes.

2. A system according to claim 1, wherein the flow rate control valve has a response which is higher than that of the EGR control valve.

3. A system according to claim 1, wherein the EGR mechanism further includes:

a branch passage branched from the EGR passage to join the exhaust system;

a second EGR control valve installed in the branch passage to regulate an amount of the exhaust gas to be recirculated; and a passage switching valve for switching the EGR passage and the branch passage;

and the EGR mechanism operating means operates the passage switching valve such that one of the EGR control valve and the second EGR control valve is selected to be operated, when the one combustion mode is determined to be changed to the other.

4. A system according to claim 1, wherein the flow rate control valve is equipped at the EGR passage downstream of the EGR control valve in terms of the exhaust gas flow to be recirculated.

5. A system according to claim 1, wherein the engine is a direct injection spark ignition engine operated at a plurality of the combustion modes comprising stratified-charge combustion and premix-charge combustion.

6. A system according to claim 1, wherein the EGR mechanism further includes:

a branch passage branched from the EGR passage to join the exhaust system;

a second EGR control valve equipped at the branch passage to regulate the amount of the exhaust gas to be recirculated; and a second flow rate control valve installed in the branch passage to regulate flow rate of the exhaust gas to be recirculated;

and the EGR mechanism operating means selectively operates at least one of the EGR control valve, the flow rate control valve, the second EGR control valve and the second flow rate control valve, when the one combustion mode is determined to be changed to the other.

7. A system according to claim 6, wherein the EGR mechanism operating means selectively operates at least one of a set of the EGR control valve and the flow rate control valve, and a set of the second EGR control valve and the second flow rate control valve, when the one combustion mode is determined to be changed to the other.

8. A system according to claim 6, wherein the second flow rate control valve is equipped at the branch passage downstream of the second EGR control valve in terms of the exhaust gas flow to be recirculated.

9. A system for controlling an EGR mechanism, installed on an internal combustion engine, having an EGR passage connecting an air intake system and an exhaust system of the engine to recirculate a portion of exhaust gas produced by the engine to the air intake system and an EGR control valve equipped at the EGR passage to regulate an amount of the exhaust gas to be recirculated; comprising;

engine operating condition detecting means for detecting operating conditions of the engine;

combustion mode determining means for determining one of a plurality of combustion modes of the engine based on the detected operating conditions of the engine; and EGR mechanism operating means for operating an EGR control valve of the EGR mechanism based on the detected operating conditions of the engine;

wherein the system includes an actuator for regulating an opening of a throttle valve provided at the air intake system; and the EGR mechanism operating means operates the EGR control valve and the actuator, when the one combustion mode is determined to be changed to other of a plurality of the combustion modes.

10. A system according to claim 9, wherein the EGR mechanism further includes:

a branch passage branched from the EGR passage to join the exhaust system;

a second EGR control valve installed in the branch passage to regulate an amount of the exhaust gas to be recirculated; and a passage switching valve for switching the EGR passage and the branch passage;

and the EGR mechanism operating means operates the passage switching valve such that one of the EGR control valve and the second EGR control valve is selected to be operated, when the one combustion mode is determined to be changed to the other.

11. A system according to claim 9, wherein the engine is a direct injection spark ignition engine operated at a plurality of the combustion modes comprising stratified-charge combustion and premix-charge combustion.

12. A system according to claim 9, wherein the EGR mechanism operating means operates the EGR control valve, the flow rate control valve and the actuator, when the one combustion mode is determined to be changed to the other.

13. A system according to claim 9, wherein the actuator is a stepper motor which regulates the opening of the throttle valve such that a pressure difference between the air intake system and the exhaust system increases.

14. A system according to claim 9, wherein the EGR mechanism further includes:

a flow rate control valve equipped at the EGR passage to regulate flow rate of the exhaust gas to be recirculated;

a branch passage branched from the EGR passage to join the exhaust system;

a second EGR control valve equipped at the branch passage to regulate the amount of the exhaust gas to be recirculated; and a second flow rate control valve installed in the branch passage to regulate flow rate of the exhaust gas to be recirculated;

and the EGR mechanism operating means selectively operates at least one of the EGR control valve, the flow rate control valve, the second EGR control valve and the second flow rate control valve, when the one combustion mode is determined to be changed to the other.

15. A system according to claim 14, wherein the EGR mechanism operating means selectively operates at least one of a set of the EGR control valve and the flow rate control valve, and a set of the second EGR control valve and the second flow rate control valve, when the one combustion mode is determined to be changed to the other.

16. A system according to claim 14, wherein the flow rate control valve is equipped at the EGR passage downstream of the EGR control valve in terms of the exhaust gas flow to be recirculated.

17. A system according to claim 14, wherein the flow rate control valve has a response which is higher than that of the EGR control valve.

18. A system according to claim 14, wherein the second flow rate control valve is equipped at the branch passage downstream of the second EGR control valve in terms of the exhaust gas flow to be recirculated.

* * * * *